US008206001B2

(12) United States Patent
Piepgras et al.

(10) Patent No.: US 8,206,001 B2
(45) Date of Patent: Jun. 26, 2012

(54) METHODS AND APPARATUS FOR PROVIDING LIGHTING VIA A GRID SYSTEM OF A SUSPENDED CEILING

(75) Inventors: Colin Piepgras, Swampscott, MA (US); Tomas Mollnow, Somerville, MA (US); Frederick Morgan, Briarcliff Manor, NY (US); Kevin Dowling, Briarcliff Manor, NY (US)

(73) Assignee: Philips Solid-State Lighting Solutions, Inc., Burlington, MA (US)

( * ) Notice: Subject to any disclaimer, the term of this patent is extended or adjusted under 35 U.S.C. 154(b) by 0 days.

(21) Appl. No.: 13/289,609

(22) Filed: Nov. 4, 2011

(65) Prior Publication Data

US 2012/0044670 A1 Feb. 23, 2012

Related U.S. Application Data

(63) Continuation of application No. 11/419,660, filed on May 22, 2006, now Pat. No. 8,061,865.

(60) Provisional application No. 60/683,587, filed on May 23, 2005.

(51) Int. Cl.
*F21S 8/04* (2006.01)

(52) U.S. Cl. ..... 362/149; 362/294; 362/373

(58) Field of Classification Search ..... 362/148–150, 362/290, 373, 264, 345, 404
See application file for complete search history.

(56) References Cited

U.S. PATENT DOCUMENTS 3,665,838 A * 5/1972 Shepherd ..... 454/257
2001/0050850 A1* 12/2001 Plunk ..... 362/150

* cited by examiner

*Primary Examiner* — Sharon Payne
(74) *Attorney, Agent, or Firm* — Mark L. Beloborodov

(57) ABSTRACT

Methods and apparatus for providing sources of light, or mechanical and/or electrical connections for light sources, via a grid system of a suspended ceiling. All or a portion of a grid system for a suspended ceiling may be configured to support the generation of light. Lighting units may be coupled to various portions of the grid system in a removable and modular fashion, so as to be completely or substantially recessed above the ceiling surface, or as pendant components hanging below the ceiling surface. Lighting interface components of the grid system also may be configured to facilitate significant thermal dissipation from lighting units. In one exemplary implementation, one or more LED-based lighting units may be coupled to one or more lighting interface components of the grid system so as to provide controllable multicolor and/or essentially white light.

16 Claims, 16 Drawing Sheets

METHODS AND APPARATUS FOR PROVIDING LIGHTING VIA A GRID SYSTEM OF A SUSPENDED CEILING

CROSS-REFERENCE TO RELATED APPLICATION

This case will be a Continuation under 35 U.S.C. §120 of the parent application Ser. No. 11/419,660 filed May 22, 2006 which claims priority under 35 U.S.C. §119(e) of U.S. Provisional Application Ser. No. 60/683,587 filed May 23, 2005 entitled "LED Modules for Low Profile Lighting Applications," all of which are incorporated herein by reference.

BACKGROUND

In construction and architecture, a suspended ceiling (also referred to as a drop or dropped ceiling) commonly is used to provide a finished ceiling surface in a room or other architectural space. In some instances, often in pre-existing structures, a suspended ceiling may be installed at some level below an existing ceiling to conceal an older damaged ceiling and/or provide a new appearance in the architectural space in which the suspended ceiling is installed. In other applications, suspended ceilings may be installed in newly-constructed architectural spaces, based in part on their relative ease of installation. In one noteworthy aspect, a suspended ceiling typically permits piping, wiring and ductwork to be easily and conveniently concealed in an area between a pre-existing ceiling (or other architectural framework) and the suspended ceiling itself. This area above the suspended ceiling commonly is referred to as a plenum.

FIG. 1 generally illustrates a typical suspended ceiling implementation. A conventional suspended ceiling 1000 employs a grid system 1020 (also referred to as "grid-work") of metal channels that are suspended on wires 1100 or rods 1120 from an overhead structure (typically a pre-existing ceiling or architectural framework). The overhead structure is not explicitly shown in FIG. 1 to permit a view of the plenum 1140, or the area above the suspended ceiling 1000. The metal channels of the grid system 1020 are configured to form a regularly spaced grid (typically a 2 foot-by-2 foot or a 2 foot-by-4 foot pattern) of square or rectangular cells between the channels. The cells of the grid typically are filled with tiles or panels 1080 which drop into the grid system 1020. The tiles 1080 generally are formed of lightweight materials having a variety of finished surface textures and colors, and may be particularly designed to facilitate acoustic or thermal isolation as well as fire safety. Once installed, the tiles 1080 may be easily removed and replaced to provide access as needed to the plenum 1140 (where there may be various wiring, pipes and ductwork requiring repair or alteration).

As indicated in FIG. 1, the grid system 1020 generally includes multiple main channels 1040, which are supported by the suspension wires 1100 (or one or more rods 1120) attached to the overhead structure. The grid system also includes a plurality of cross channels 1060, which may be connected in an interlocking fashion to the suspended main channels. As illustrated in FIGS. 2(*a*), 2(*b*), and 2(*c*), the main channels and the cross channels of the grid system 1020 generally are in the shape of an upside-down "T", wherein a bottom portion 1360 of the upside-down "T" forms a set of flanges, i.e., one flange on either side of a center rib 1340 of the channel, which supports adjacent ceiling tiles 1080 resting in the grid system 1020. Various tile edge-profiles are possible such that the bottom portion 1360 of a channel may be fully or partially exposed, or completely hidden; for example, FIG. 2(*a*) illustrates a first tile configuration (essentially square edges) resulting in an exposed bottom portion 1360 of a channel, FIG. 2(*b*) illustrates a second tile configuration (bevelled edges) resulting in a recessed bottom portion 1360 of a channel, and FIG. 2(*c*) illustrates a third tile configuration (slotted edges) resulting in a hidden bottom portion 1360 of a channel, in which the flanges formed by the bottom portion of the channel are inserted into the slotted edges of the tiles.

FIGS. 3(*a*) and 3(*b*) illustrate the interlocking process of a cross channel 1060 and a main channel 1040 of the grid system 1020 shown in FIG. 1. Each main channel 1040 includes multiple slots 1300 punched periodically along the channel (e.g., every 12 inches) to provide for the attachment of cross channels 1060. Each cross channel 1060 includes end tabs 1320 that are pushed into and interlock with the slots 1300 along the main channels.

As also illustrated in FIG. 1, one or more of the cells formed by the grid system 1020 may be occupied by a lighting fixture 1200, which rests in the grid system 1020 in a manner similar to that of the tiles 1080. While the tiles 1080 are appreciably lightweight, the more substantial weight of the lighting fixture 1200 generally requires that the lighting fixture is itself suspended by wires 1100 or otherwise coupled to and supported by an overhead structure, so that it does not rely exclusively on the grid system 1020 for support. Various types of fluorescent and incandescent lighting fixtures having dimensions similar to those of the tiles 1080 are conventionally employed in suspended ceilings as substitutes for one or more tiles 1080. With reference again to FIG. 2(*a*), such lighting fixtures are generally configured to rest on top of the flanges formed by the bottom portion 1360 of the main and cross channels of the grid system 1020. Other types of conventional lighting fixtures (e.g., incandescent, fluorescent, halogen) are designed to be recessed into a hole cut into a tile 1080, such that the lighting fixture does not completely occupy a cell formed by the grid system, but merely occupies a portion of the cell area together with a remaining portion of the tile into which the fixture is recessed.

SUMMARY

Various embodiments of the present disclosure are directed to methods and apparatus for providing lighting via a grid system of a suspended ceiling. In contrast to conventional lighting fixtures that are designed to be recessed into tiles of a suspended ceiling, or replace such tiles so as to fill a cell formed by a conventional grid system, methods and apparatus pursuant to the present disclosure are directed to providing sources of light, or mechanical and/or electrical connections for light sources, via the grid system itself.

According to various aspects of the present disclosure, all or a portion of a grid system for a suspended ceiling may be configured to support the generation of light, and a variety of lighting units may be coupled to different portions of the grid system in a removable and modular fashion. Lighting interface components of the grid system may be configured such that lighting units may be completely or substantially recessed above the finished surface of the suspended ceiling, or pendant components hanging below the ceiling surface once coupled to the grid system. In other aspects, lighting interface components of the grid system may be configured to facilitate significant thermal dissipation from lighting units. In one exemplary implementation, one or more LED-based lighting units may be coupled to one or more lighting interface components of the grid system so as to provide controllable multi-color and/or essentially white light.

As discussed in further detail below, one embodiment of the present disclosure is directed to a lighting interface component that forms at least a portion of a grid system for a suspended ceiling. The lighting interface component comprises a first flange configured to support a first ceiling tile when the first ceiling tile is installed in the suspended ceiling, and a second flange configured to support a second ceiling tile when the second ceiling tile is installed in the suspended ceiling. The lighting interface component further comprises a central channel portion disposed between the first flange and the second flange and configured to provide at least one of a mechanical connection and an electrical connection to at least one lighting unit when the at least one lighting unit is coupled to the central channel portion.

Another embodiment is directed to a lighting system, comprising at least one lighting interface component that forms at least a portion of a grid system for a suspended ceiling, and at least one lighting unit coupled to the at least one lighting interface component.

Another embodiment is directed to a suspended ceiling, comprising a plurality of tiles, and a grid system for supporting the plurality of tiles. The grid system includes a plurality of main channels and a plurality of cross channels arranged in a grid pattern. At least a portion of at least one main channel or at least one cross channel comprises a lighting interface component. The lighting interface component comprises a first flange configured to support a first ceiling tile of the plurality of tiles when the first ceiling tile is installed in the suspended ceiling, and a second flange configured to support a second ceiling tile of the plurality of tiles when the second ceiling tile is installed in the suspended ceiling. The lighting interface component further comprises a central channel portion disposed between the first flange and the second flange and configured to provide at least one of a mechanical connection and an electrical connection to at least one lighting unit when the at least one lighting unit is coupled to the central channel portion.

Another embodiment is directed to a lighting unit configured to be installed in at least a portion a grid system of a suspended ceiling. The grid system includes at least one lighting interface component configured to provide at least one of a mechanical connection and an electrical connection to the lighting unit. The lighting unit comprises at least one structural feature that mechanically engages with the at least one lighting interface component of the grid system in an interlocking manner so as to form the mechanical connection. The lighting unit further comprises at least one LED-based light source.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The terms "lighting unit" and "lighting fixture" are used interchangeably herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

FIG. 10(*c*) illustrates a lighting system including the lighting unit shown in FIGS. 10(*a*) and 10(*b*).

DETAILED DESCRIPTION

Following below are more detailed descriptions of various concepts related to, and embodiments of, methods and apparatus for providing lighting from a grid system of a suspended ceiling. It should be appreciated that various concepts introduced above and discussed in greater detail below may be implemented in any of numerous ways. In particular, some embodiments of the present disclosure described below relate particularly to LED-based light sources. It should be appreciated, however, that the present disclosure is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

Figure 4:
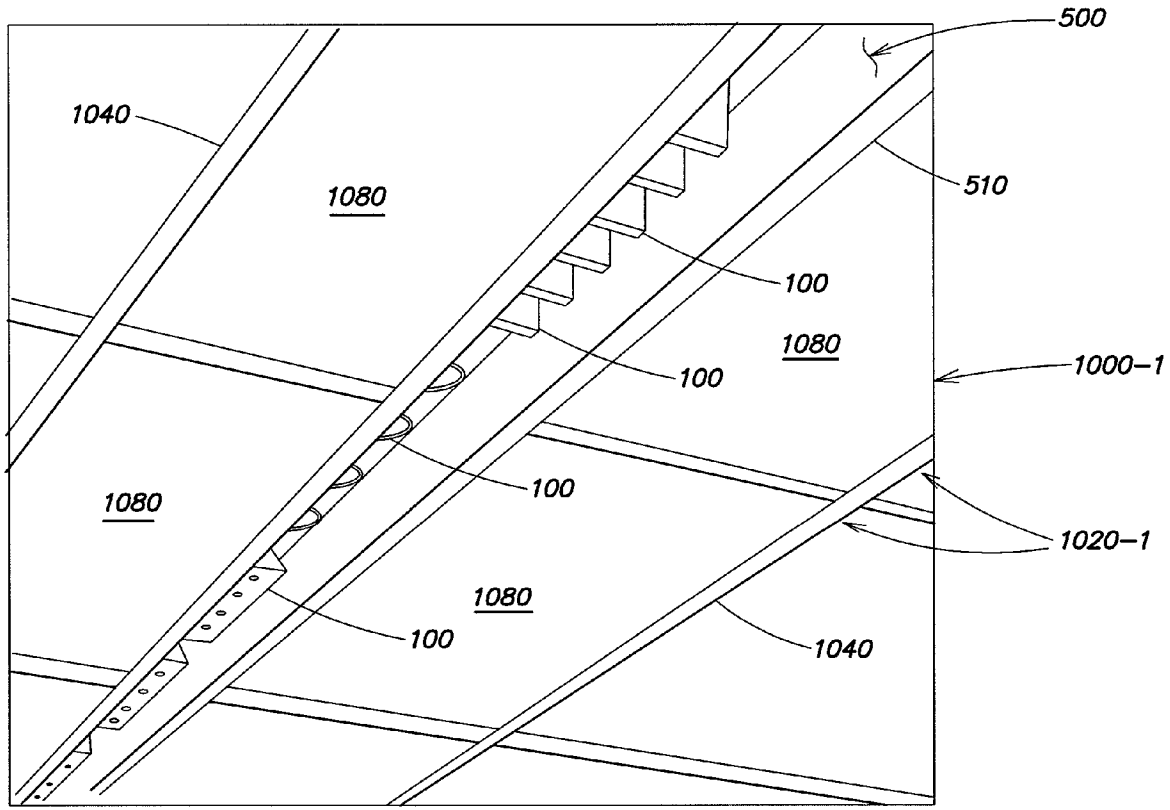
FIG. 4 illustrates a suspended ceiling according to one embodiment of the present disclosure, in which at least a portion of a grid system for the suspended ceiling comprises a lighting system.

FIG. 4 illustrates a suspended ceiling 1000-1 according to one embodiment of the present disclosure, in which at least a portion of a grid system 1020-1 for the suspended ceiling 1000-1 comprises a lighting system 500. In one implementation, the lighting system 500 includes one or more lighting interface components 510 that form at least a portion of the grid system 1020-1, and one or more lighting units 100 coupled to the lighting interface component(s) 510. Various types of lighting units 100 suitable for use in the lighting system 500, including LED-based lighting units, are discussed in greater detail below (e.g., in connection with FIGS. 15 and 16).

Figure 1:
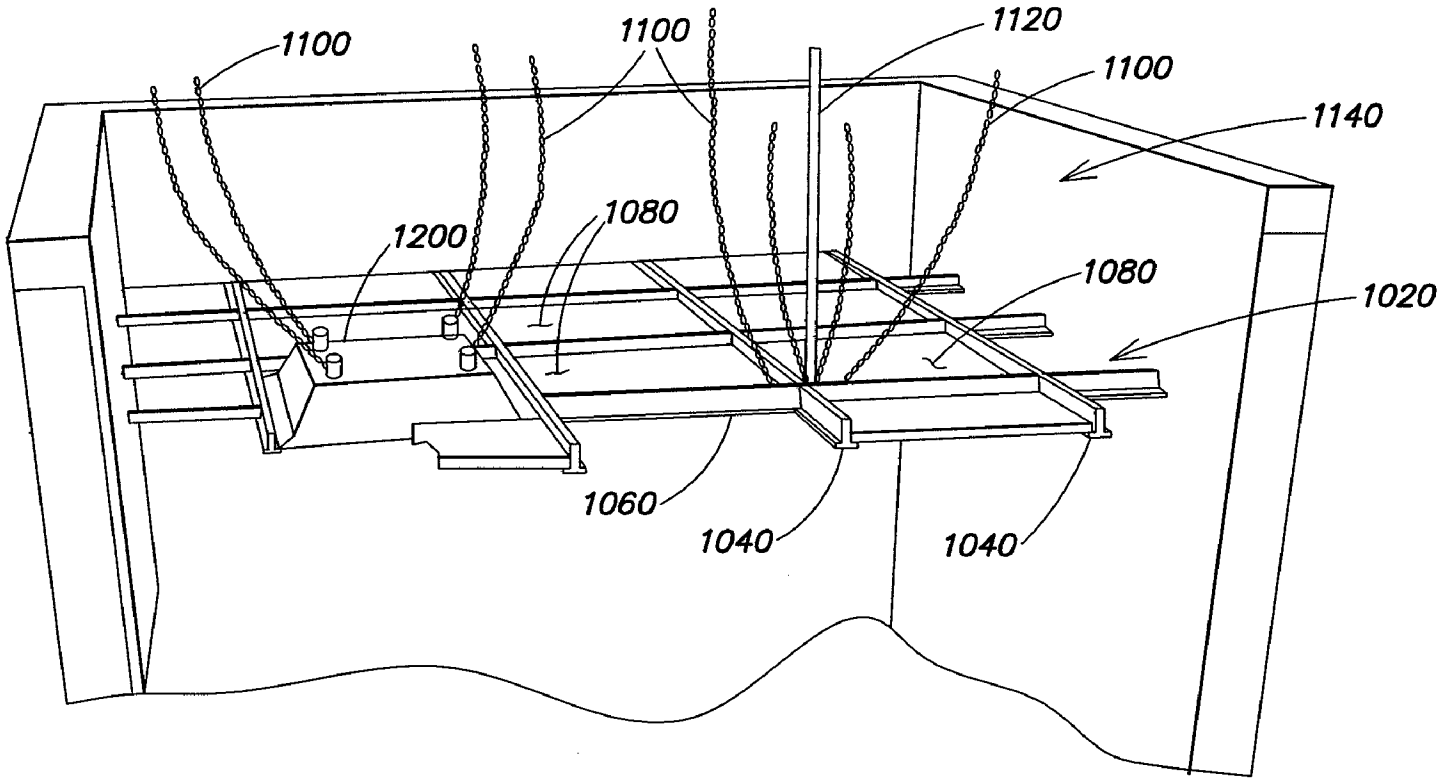
FIG. 1 generally illustrates a typical suspended ceiling implementation.
Figure 2A:
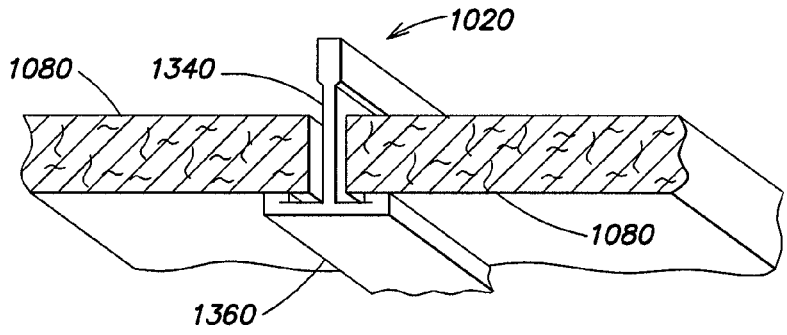
FIGS. 2(*a*), 2(*b*) and 2(*c*) illustrate the general configuration of channels of a grid system and tiles supported by the channels of the grid system of the suspended ceiling shown in FIG. 1.
Figure 2B:
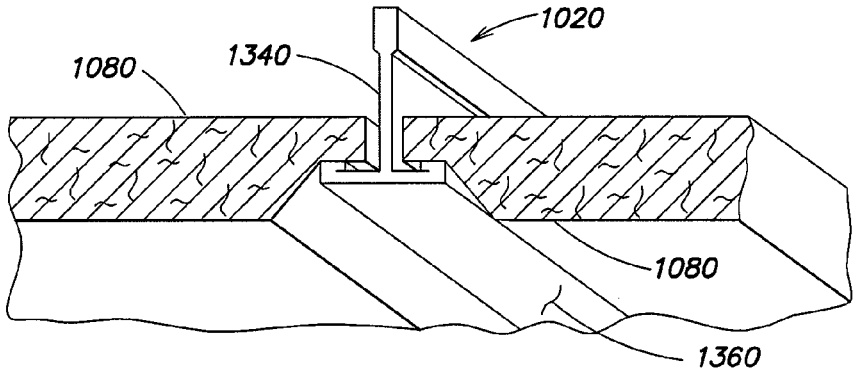
Figure 2C:
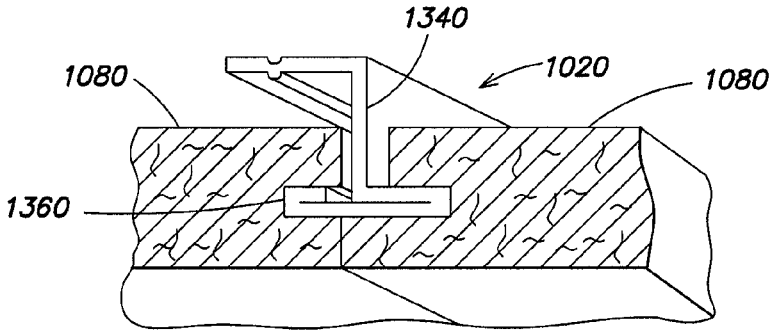
Figure 3A:
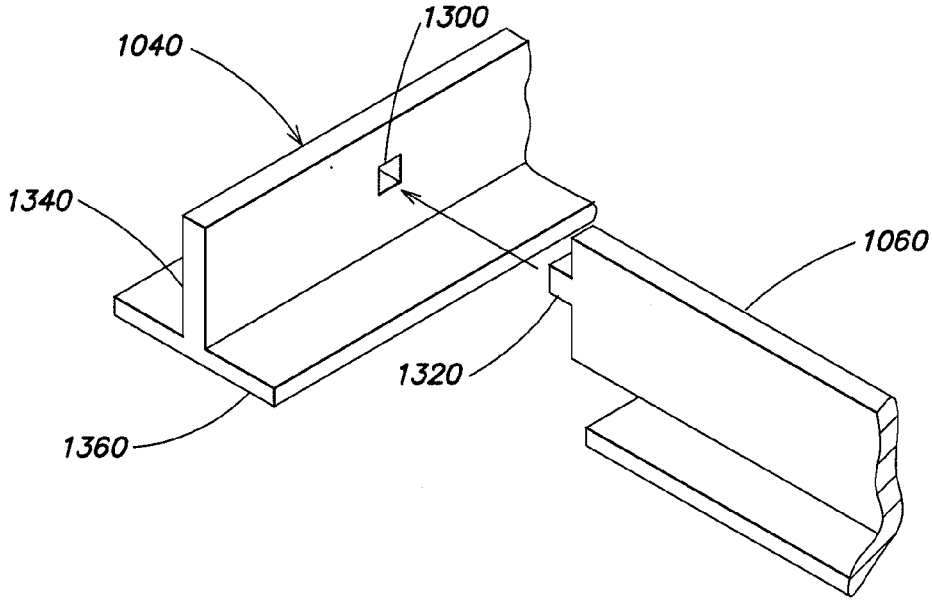
FIGS. 3(*a*) and 3(*b*) illustrate the interlocking process of a cross channel and a main channel of the grid system shown in FIG. 1.
Figure 3B:
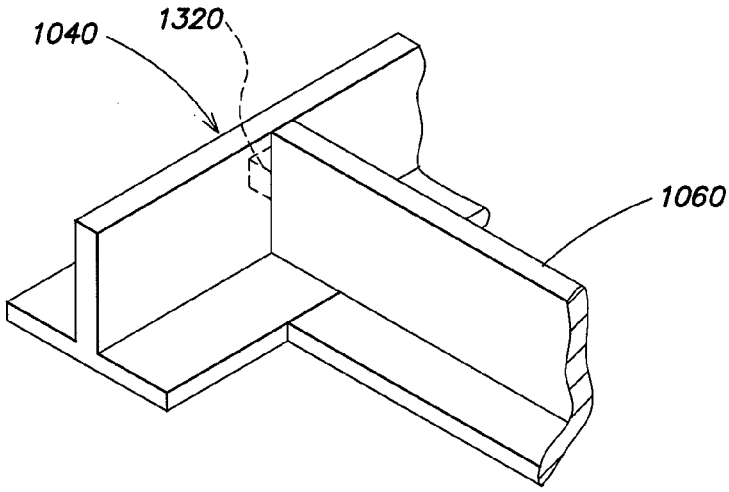

As can be seen in FIG. 4, one or more lighting interface components 510 may form only a portion of the grid system 1020-1. In such an implementation, the grid system may include one or more conventional main channels 1040 and one or more conventional cross channels 1060 as discussed above in connection with FIGS. 1-3. While the lighting interface component 510 illustrated in FIG. 4 is disposed parallel to conventional main channels 1040, thereby forming at least a portion of a main channel of the grid system 1020-1, it should be appreciated that grid systems for suspended ceilings according to the present disclosure are not limited in this respect, as one or more lighting interface components 510 may form all or a portion of one or more cross channels of the grid system in addition to (or instead of) one or more main channels.

Figure 5:
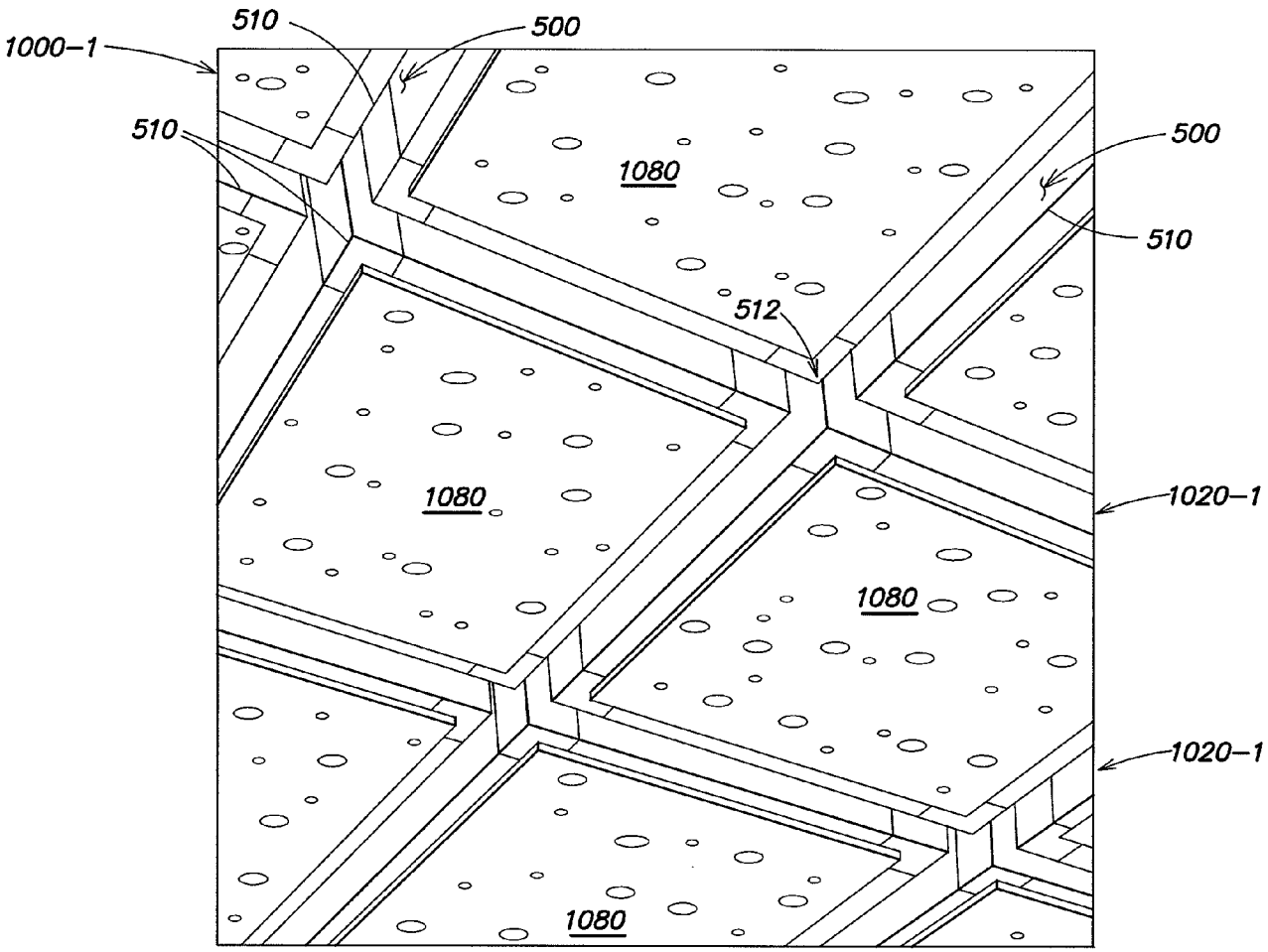
FIG. 5 illustrates another embodiment of a suspended ceiling according to the present disclosure, in which a substantial portion of (or essentially all of) the grid system provides a distributed lighting system throughout the suspended ceiling.

For example, FIG. 5 illustrates another implementation of a suspended ceiling 1000-1 according to the present disclosure, in which one or more lighting interface components 510 are formed and configured so as to constitute a substantial portion of (or essentially all of) the grid system 1020-1 (i.e., including multiple main channels and multiple cross channels) to provide a distributed lighting system 500 throughout the suspended ceiling. In the embodiment of FIG. 5, lighting interface component(s) 510 also may be particularly formed so as to provide one or more intersections 512 between main channels and cross channels of the grid system.

Figure 6:
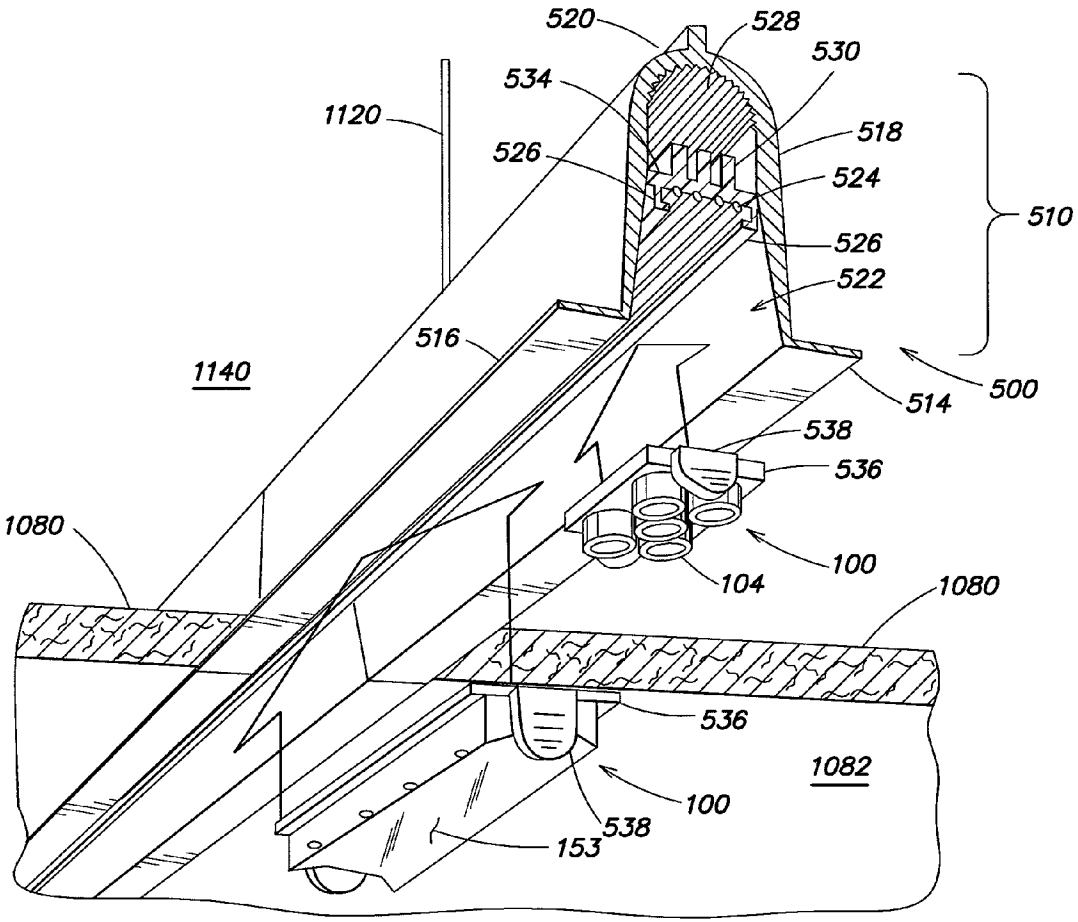
FIGS. 6 and 7 illustrate perspective and cross-sectional end views, respectively, of a lighting system that constitutes at least a portion of a suspended ceiling grid system, according to one embodiment of the present disclosure.
Figure 7:
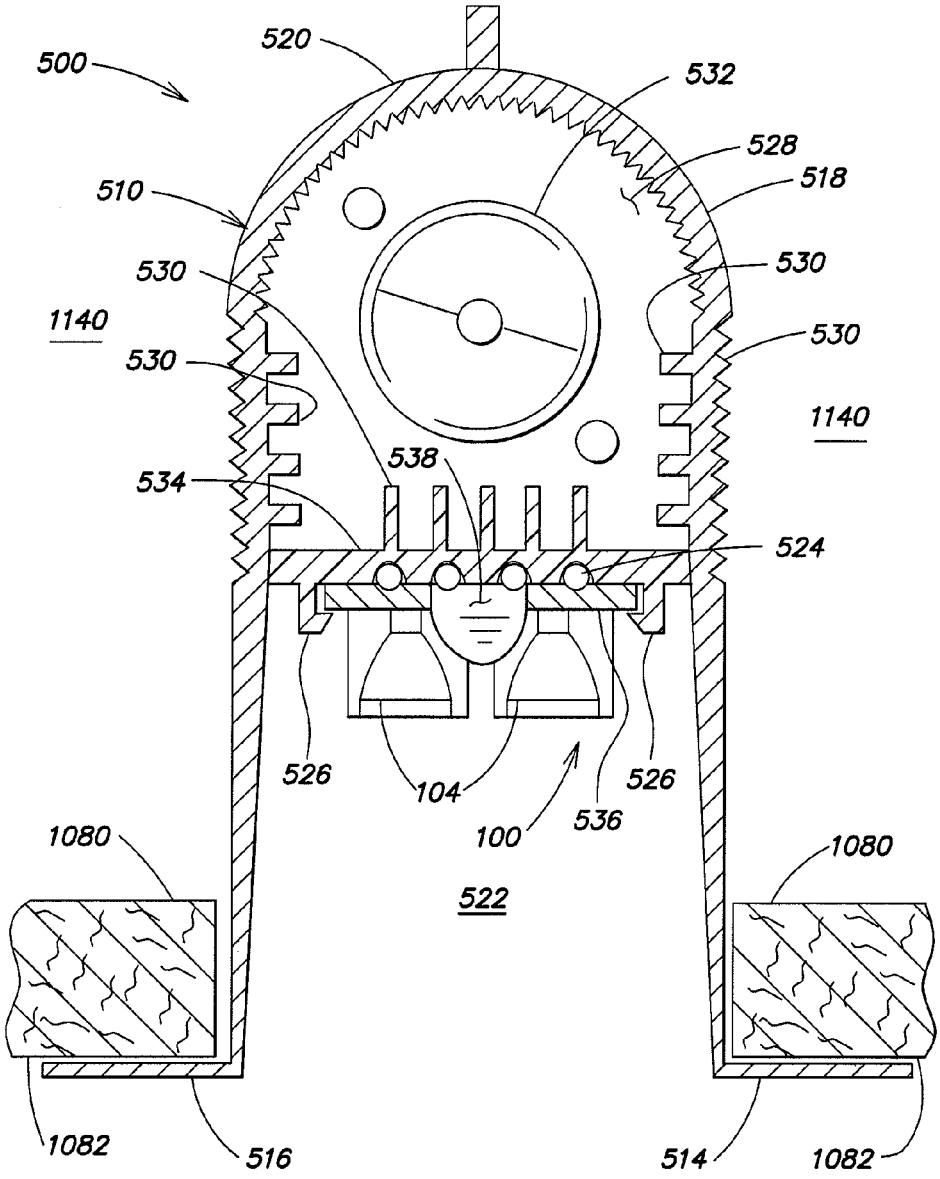

FIGS. 6 and 7 illustrate perspective and cross-sectional end views, respectively, of a lighting system 500 formed as at least a portion of a suspended ceiling grid system, according to one embodiment of the present disclosure. The lighting system 500 includes one or more lighting units 100 having one or more light sources 104. As discussed above in connection with FIG. 4, the lighting unit(s) are coupled to one or more lighting interface components 510 that may be suspended via a rod 1120 or wire, or otherwise coupled to, an overhead structure above the suspended ceiling. In various aspects, the lighting interface component(s) 510 may be formed of a variety of materials including, but not limited to, metal (e.g., extruded sheet metal) or plastic. In one aspect, low thermal resistance materials may be used for the lighting interface component(s) to facilitate thermal conduction and heat dissipation from the lighting unit(s) 100 coupled to the lighting interface component(s).

As shown in FIGS. 6 and 7, a lighting interface component 510 of this embodiment comprises first and second flanges 514 and 516 to support ceiling tiles 1080 when the ceiling tiles are installed in the suspended ceiling. The lighting interface component 510 also comprises a central channel portion 520 disposed between the first flange 514 and the second flange 516. The central channel portion 520 is configured to provide one or both of a mechanical connection and an electrical connection to one or more lighting units 100 when the lighting unit(s) are coupled to the central channel portion 520. The central channel portion 520 includes a structural support member 518 that is mechanically coupled to the first and second flanges 514 and 516; in one aspect, the structural support member 518 may be formed integrally with the first and second flanges (e.g., as a single piece of bent extruded sheet metal or extruded/molded plastic form).

In the embodiment of FIGS. 6 and 7, as well as other embodiments discussed further below, the structural support member 518 generally is configured to extend into the plenum 1140 above the tiles 1080 of the suspended ceiling. However, it should be appreciated that the present disclosure is not limited in this respect, as the structural support member 518 may be configured to be essentially coplanar with the flanges, or alternatively extend into the space of a room below the tiles of the suspended ceiling. In the particular embodiment illustrated in FIGS. 6 and 7, the structural support member 518 is formed as an essentially upside down U-shaped member having a generally curved shape in cross-section. However, again the disclosure is not limited in these respects, as in other embodiments discussed below the structural support member 518 may have a variety of angular shapes (e.g., a cross-section having an essentially rectangular or trapezoidal shape—see FIGS. 8 and 9).

Regardless of a particular overall shape or cross-section profile, the structural support member 518 in the specific embodiment of FIGS. 6 and 7 generally is configured to form a space 522 in which one or more lighting units 100 are inserted, such that at least a portion of the lighting unit(s), when coupled to the lighting interface component 510, resides above a lower (perceived or visible) surface 1082 of the suspended ceiling. FIG. 7 particularly illustrates a lighting unit 100 that resides completely above the lower surface of the suspended ceiling when the lighting unit is inserted into the space 522 and coupled to the lighting interface component 510. In another aspect, the structural support member 518 may be configured to form the space 522 such that a lighting unit is essentially flush with the lower surface of the suspended ceiling once coupled to the lighting interface component. For example, as shown in FIG. 6, a given lighting unit 100 may include a light exit surface 153, and the space 522 and the lighting unit 100 may be appropriately dimensioned such that the light exit surface 153 of the lighting unit is essentially coplanar or flush with the lower surface of the suspended ceiling when the lighting unit is coupled to the lighting interface component. This concept is further discussed below in connection with the embodiment illustrated in FIG. 10(*c*).

As mentioned above, the lighting interface component 510 of FIGS. 6 and 7 provides one or both of a mechanical connection and an electrical connection to one or more lighting units 100 coupled to the lighting interface component 510. In the embodiment of FIGS. 6 and 7, the lighting interface component provides both a mechanical and an electrical connection in this regard, but it should be appreciated that this is not a requirement in all embodiments pursuant to the present disclosure. More generally, according to various embodiments, one or both of the mechanical and electrical connections may be interlocking connections (e.g., involving complementary mating components) that provide robust connections which are nonetheless relatively easily undone (so as to facilitate insertion and removal of lighting units).

With respect to an electrical connection, in various embodiments described herein an electrical connection may provide one or both of operating power to one or more lighting units coupled to the lighting interface component(s) 510, as well as one or more control signals (e.g., lighting commands, instructions, information, data) to facilitate control of one or more lighting units (e.g., vary some aspect of light generated by the lighting unit(s)). In general, a number of electrical connection arrangements are possible, some of which may be physically integrated with the structural support member 518 and others of which may be merely located in proximity to the structural support member but not actually form a part of the structural support member. For example, in one embodiment, the electrical connection may be provided by any one of a number of conventional plug-in style connectors (e.g., having mating male and female counterparts) attached to wires that are routed through the structural support member 518. In such an embodiment, the structural support member 518 serves primarily to provide a mechanical connection to one or more lighting units, and once the lighting unit(s) are mechanically coupled to the structural support member (e.g., snapped into place), the electrical connection is made via plugging in one of a male or female portion of plug-in style connector associated with the lighting unit(s) to its counterpart in proximity to the structural support member.

In other embodiments, the electrical connection may be more integrally associated with the structural support member 518. For example, in one embodiment, the electrical connection may include a plurality of electrical contact points disposed on the structural support member 518. Such contact points may be positioned at periodic discrete locations to accommodate multiple lighting units at the discrete locations. Alternatively, such contact points may be frequently distributed along a length of the lighting interface component(s) to provide an electrical connection to one or more lighting units at essentially arbitrary locations along the lighting interface component(s) 510. In various implementations, the number of electrical contact points may vary depending on the type of lighting units to be coupled to the lighting interface component(s). For example, in some embodiments, one pair of electrical contact points may be employed to convey operating power to the lighting unit(s), and one or more additional pairs of contact points may be provided to convey control signals to control various aspects of light generation from the lighting unit(s). In one embodiment, only one pair of electrical contact points may be employed to convey both operating power and one or more lighting control signals, pursuant to a "power/data protocol" as described in U.S. Pat. No. 6,292,901, hereby incorporated herein by reference.

As illustrated in FIG. 6, in one embodiment the electrical connection comprises a plurality of conductive tracks 524 coupled to the structural member 518 (in the cross-sectional end view of FIG. 7, these conductive tracks 524 appear as circular contact points in the figure). In implementations in which the structural member 518 may include metal or otherwise electrically conductive portions, the central channel portion 520 may include a cross member 534 coupled to the structural member 518, wherein the cross member may be formed of an electrically insulating material to which the conductive tracks 524 are mounted (e.g., adhered or otherwise affixed). In one implementation, the cross member 534 may itself not be formed of an electrical insulator, but may have a surface on which is disposed (e.g., deposited or adhered) an electrically insulating material, to which the conductive tracks 524 in turn are mounted. In various aspects, the conductive tracks 524 may be essentially rigid metal tracks disposed in parallel continuously or intermittently along a length of the lighting interface component 510. Alternatively, the conductive tracks 524 may be fabricated on a mylar strip or other similar substrate that is in turn coupled to the cross member 534.

With respect to a mechanical connection, a variety of interlocking mechanical connections may be employed in different embodiments of lighting interface components to facilitate robust connections that nonetheless allow lighting units 100 to be easily installed and removed from the lighting interface component(s) 510. As discussed further below in connection with FIGS. 8 and 9 for example, compression-type, deformable, or "snap-fit" mechanical connections may be employed in this regard. In the embodiment shown in FIGS. 6 and 7, a sliding mechanical connection is employed that is provided by two rails 526 depending from the cross member 534 coupled to the structural member 518. The rails 526 are configured to engage with a platform 536 (or substrate or other housing feature) associated with a lighting unit 100, wherein the lighting unit may be slid into place along the rails 526 via a tab 538. In one aspect, the rails 526 are appropriately dimensioned based on the platform 536 of the lighting unit 100 such that electrical contact is maintained between the conductive tracks 524 and complimentary electrical contacts disposed on the platform 536 of the lighting unit 100 (these contacts are not explicitly shown in the view of FIGS. 6 and 7).

In yet other aspects of the lighting interface component 510 illustrated in the embodiment of FIGS. 6 and 7, the central channel portion 520 may be particularly formed so as to facilitate a significant flow of air and/or thermal conduction in the central channel portion when one or more lighting units are coupled to the central channel portion, so as to dissipate heat generated by the lighting unit(s). To this end, as illustrated in FIG. 6, in one aspect the structural member 518 may be formed from a low thermal resistance material, and the central channel portion 520 configured with an essentially hollow conduit 528 through which air may flow freely. In another aspect, the conduit 528 may be configured with a variety of internal and/or external surface features 530 including, but not limited to, protrusions, fins, channels, saw-tooth surface perturbations, and the like, to increase surface area and thereby facilitate heat dissipation. As also shown schematically in FIG. 7, one or more air circulation devices 532 (e.g., one or more fans) may be disposed in the conduit 528, and coupled in any of a variety of manners to the support member 518, to facilitate a flow of air in the conduit 528.

With respect to air circulation in connection with the central channel portion 520 and heat dissipation via the lighting interface component 510, it should be appreciated that generally there are various electrical and building codes relating to the plenum 1140 above the suspended ceiling. In particular, generally there are regulations that apply to electrical devices installed in plenums, as any fire in electrical equipment may cause fumes and smoke to circulate in the plenum and possibly throughout a building. Accordingly, applicable regulations often significantly limit or prohibit any air exchange from the plenum to the room or other architectural space below the ceiling. While a plenum air to room air exchange should be excluded from the design of lighting interface components, the design nonetheless may permit thermal exchange while prohibiting air exchange. Thus, any air flow/circulation spaces incorporated into the lighting interface component(s) may be open to the room below but should be isolated from the plenum. As illustrated in FIGS. 6 and 7, air flow through the conduit 528 may be prohibited from entering the plenum via the structural support member, but one or more perforations may be included in the cross member 534 to allow air exchange with the space below the ceiling. Alternatively, one or more end caps for the lighting interface component(s) may be employed with one or more conduits or air flow channels that connect the conduit 528 to the space below the ceiling.

Figure 8:
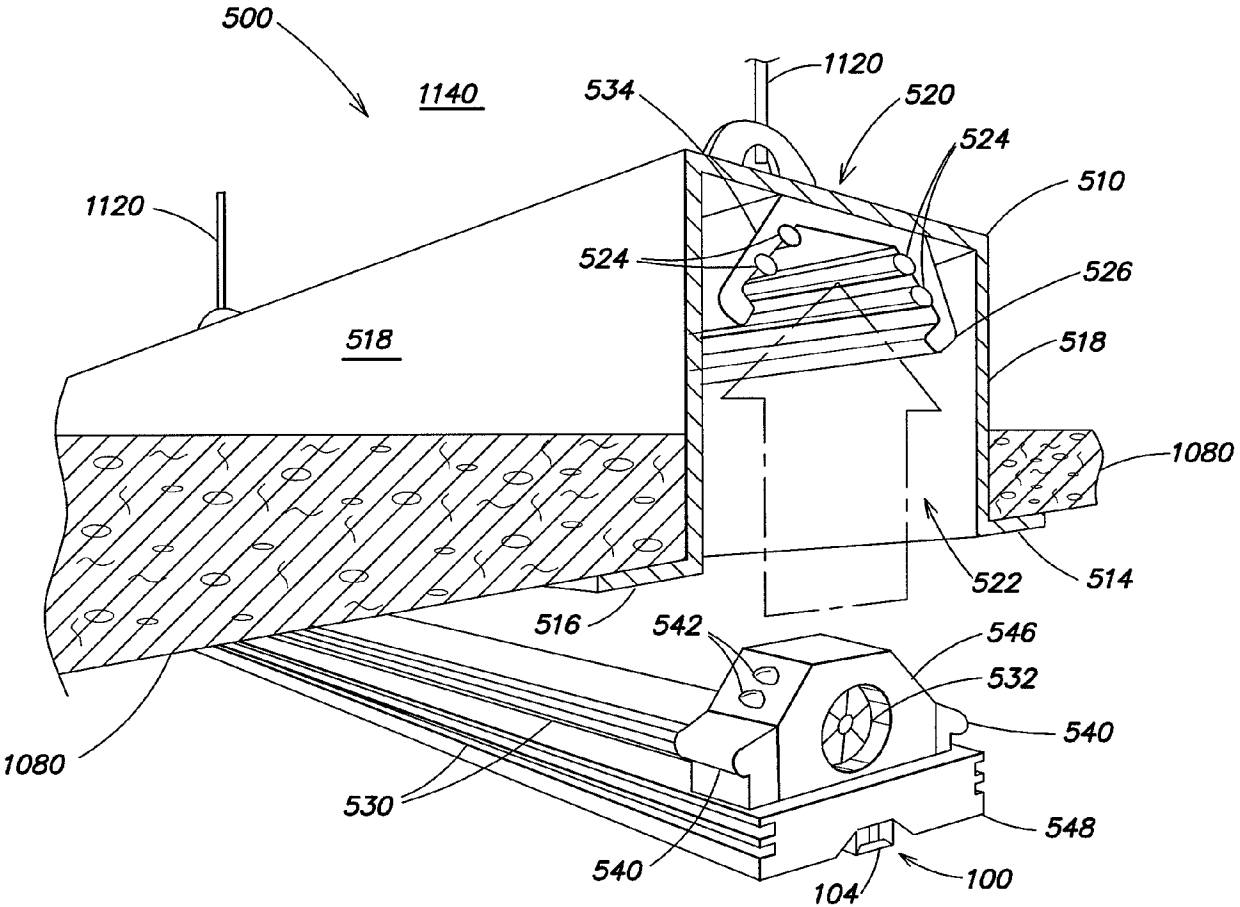
FIGS. 8 and 9 illustrate perspective and cross-sectional end views, respectively, of a lighting system that constitutes at least a portion of a suspended ceiling grid system, according to another embodiment of the present disclosure.
Figure 9:
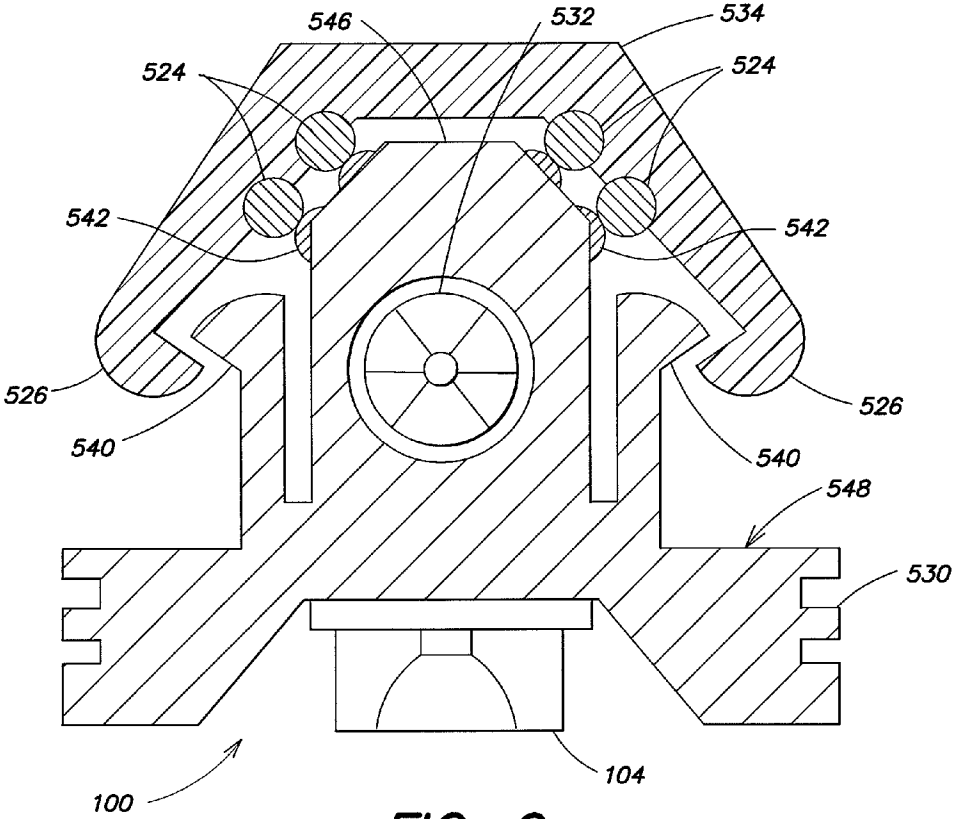

FIGS. 8 and 9 illustrate perspective and cross-sectional end views, respectively, of a lighting system 500 that constitutes at least a portion of a suspended ceiling grid system, according to another embodiment of the present disclosure. In FIGS. 8 and 9, like reference numerals are used to indicate components identical or analogous to those illustrated in the embodiment of FIGS. 6 and 7. One noteworthy difference in the embodiment of FIGS. 8 and 9 is that the structural support member 518 of the central channel portion 520 has a substantially angular (e.g., rectangular) shape as opposed to the curved shape shown in FIGS. 6 and 7. Additionally, the cross member 534 of the central channel portion 520 shown in FIGS. 8 and 9 has an essentially trapezoidal shape as opposed to being a substantially flat member, on which are disposed the conductive tracks 524. The cross member 534 of FIGS. 8 and 9 nonetheless is configured to provide rails 526 that facilitate a mechanical connection with one or more lighting units 100.

Another salient difference in the embodiment of FIGS. 8 and 9 is that primarily the lighting unit 100 itself, rather than the lighting interface component 510, is particularly configured to facilitate a flow of air proximate to the lighting unit when the lighting unit is coupled to the lighting interface component 510. For example, in one aspect, the lighting unit 100 of FIGS. 8 and 9 includes an air circulation device 532 disposed in a housing 546 that resides on an essentially planar and linear base member 548 of the lighting unit 100. The housing 546 includes a plurality of electrical contacts 542 that form the electrical connection with the conductive tracks 524 of the lighting interface component 510 when the lighting unit is coupled to the lighting interface component. A pair of resilient tabs 540 flank the housing 546, and engage with the rails 526 of the cross member 534. The rails 526 form essentially rigid members to facilitate an interlocking snap-fit mechanical connection with the resilient tabs 540 when the lighting unit is coupled to the lighting interface component. The base member 548 of the lighting unit may be fabricated of a low thermal resistance material and configured with a variety of surface features 530 including, but not limited to, protrusions, fins, channels, saw-tooth surface perturbations, and the like, to increase surface area and thereby facilitate heat dissipation. When the lighting unit 100 of FIGS. 8 and 9 is inserted into the space 522 created by the central channel portion 520, and mechanically and electrically engaged with the lighting interface component 510, a conduit for air flow (similar to the conduit 528 shown in FIGS. 6 and 7) is formed in an area between the cross member 534 and a top surface of the base member 548 of the lighting unit.

Figure 10B:
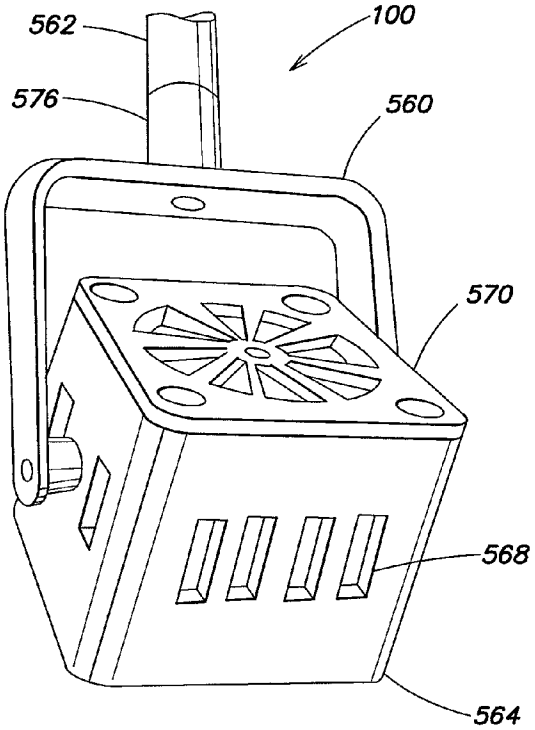
FIGS. 10(*a*) and 10(*b*) illustrate different views of a lighting unit configured as a spot light and including a variety of structural components to facilitate coupling of the spot light to the lighting interface component shown in FIGS. 8 and 9, according to another embodiment of the present disclosure.
Figure 10A:
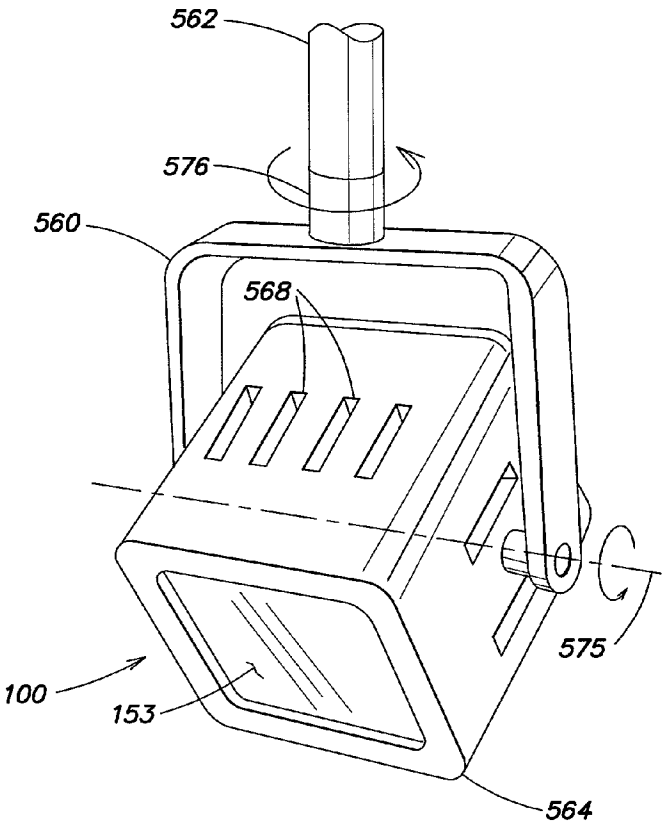
Figure 10C:
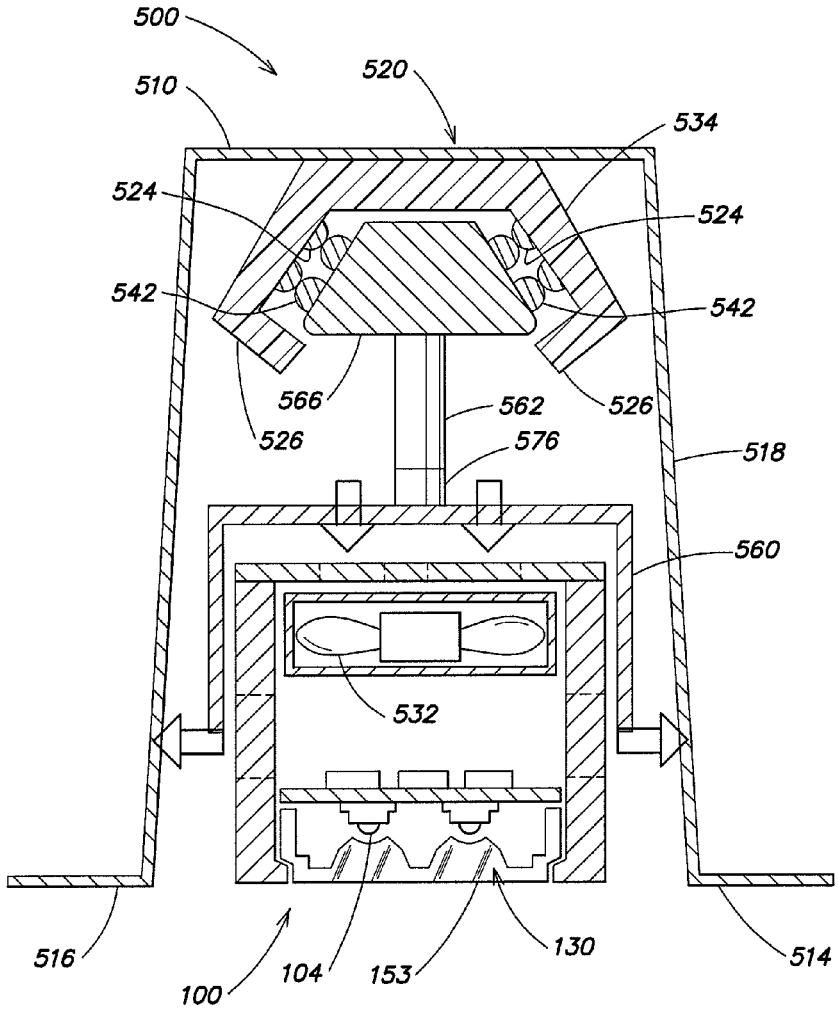

While the lighting unit 100 depicted in the embodiment of FIGS. 8 and 9 has a substantially linear profile and is configured to form a snap-fit interlocking mechanical connection with the lighting interface component 510, it should be appreciated that the present disclosure is not limited in this respect, and that the configuration of the lighting interface component 510 illustrated in FIGS. 8 and 9 may be employed for use with other types of lighting units. For example, FIGS. 10(*a*) and 10(*b*) illustrate different views of a lighting unit 100 configured as an essentially cube-shaped spot light, according to another embodiment. In this embodiment, the lighting unit 100 includes a variety of structural components to facilitate coupling of the lighting unit to the lighting interface component, as well as positioning of a light beam generated by the lighting unit. FIG. 10(*c*) illustrates a lighting system 500 incorporating such a spot light. In one aspect, the lighting system of FIG. 10(*c*) generally resembles a conventional "track lighting" system in overall look and implementation, in that one or more individual lighting units are positioned at arbitrary locations along a track system formed by the ceiling grid system, wherein each of the lighting units has a variety of positioning and orientation options for directing generated light.

More specifically, as illustrated in the different perspective views of FIGS. 10(*a*) and 10(*b*), the lighting unit 100 of this embodiment may have an essentially cube-shaped housing 564 that includes one or more ventilation ports 568. A front or light exit face 153 of the lighting unit may be formed by an essentially transparent or translucent material serving as a general light diffuser, and/or configured particularly with an optical facility 130 including one or more specific optical elements (see FIG. 10(*c*)) that affect the light generated (e.g., focus, beam direction, etc.). The lighting unit also may include a removable rear back plate 570 to permit access to internal lighting unit components (e.g., an air circulation device 532, as shown in FIG. 10(*c*), and/or other control components), and the back plate 570 also may be equipped with ventilation ports similar to those found in the housing.

In the embodiment of FIGS. 10(*a*), 10(*b*) and 10(*c*), a U-bracket 560 is coupled to the lighting unit housing 564 so as to allow pivoting (rotation) of the lighting unit about a pivot axis 574. The U-bracket 560 also is coupled to an arm 562 including a swivel 576 to allow rotation of the lighting unit about an axis defined by the arm 562. In another possible implementation, a gimbal mechanism may be employed to further facilitate a rotation of the lighting unit about the plane defined by the light exit face 153. As illustrated in FIG. 10(*c*), the top of the arm 562 is attached to a head 566 configured to engage mechanically with the cross member 534 of the central channel portion 520 of the lighting interface component 510. The head 566 also includes a plurality of electrical contacts 542 that form the electrical connection with the conductive tracks 524 of the lighting interface component 510 when the lighting unit is coupled to the lighting interface component. Electrical connections between the contacts 542 and the body of the lighting unit 100 may be accomplished via wires running through a conduit in the arm 562 and swivel 576.

In one implementation, the head 566 of the lighting unit 100 shown in FIG. 10(*c*) may be configured so as to form a sliding mechanical engagement with the rails 526 of the cross member 534. In another implementation, the head 566 may be configured with resilient tabs, similar to the tabs 540 shown in FIGS. 8 and 9, to facilitate an interlocking snap-fit mechanical connection with the rails 526. In one aspect, as illustrated in FIG. 10(*c*), the lighting interface component 510 and the various structural components of the lighting unit 100 may be configured such that the light exit face 153 of the lighting unit is essentially flush with the lower surface of the suspended ceiling (as represented by the flanges 514 and 516 in FIG. 10(*c*)) when the lighting unit is rotated on the pivot axis 574 to be pointing directly down (i.e., along an axis defined by the arm 562).

From the foregoing, it may be appreciated that a wide variety of lighting unit shapes, sizes and types may be coupled to different lighting interface components according to the present disclosure to provide lighting via a grid system of a suspended ceiling. In addition to the generally linear and cube-like profiles discussed above, lighting units having circular or oval profiles may be employed in the lighting systems disclosed herein. With reference again to FIG. 4, as shown generally in the figure, a number of different types and overall profiles of lighting units 100 may be employed together in a given lighting system installation in connection with a suspended ceiling pursuant to the concepts disclosed herein.

Figure 11:
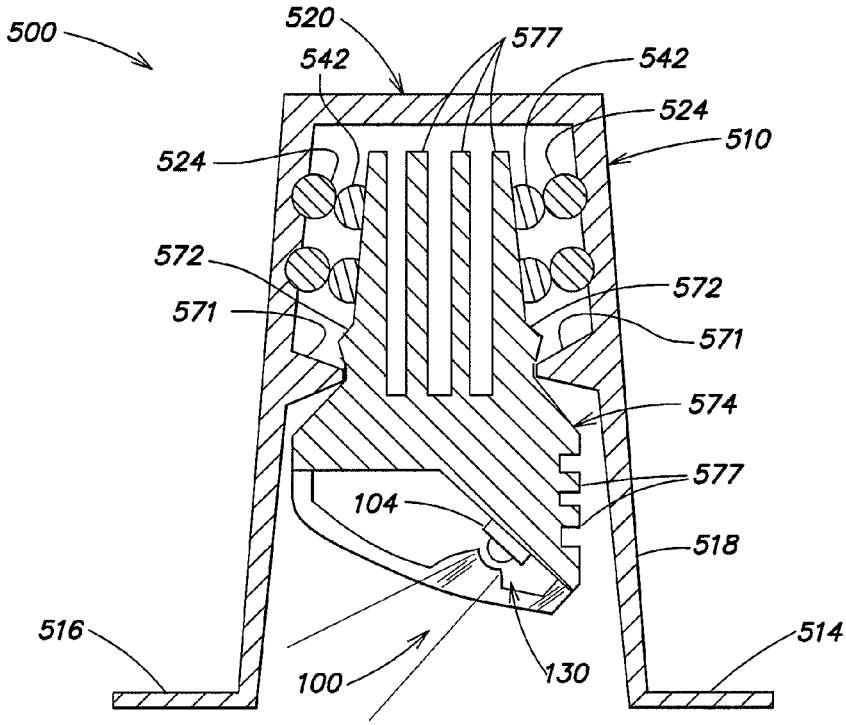
FIG. 11 illustrates a cross-sectional end view of a lighting system that constitutes at least a portion of a suspended ceiling grid system, according to another embodiment of the present disclosure.
Figure 12:
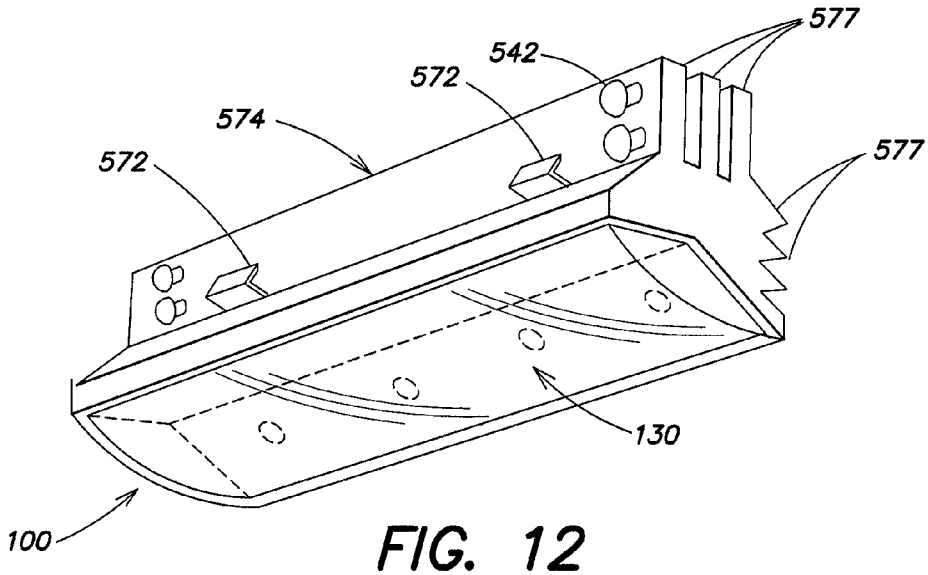
FIG. 12 illustrates a perspective view of the lighting unit shown in FIG. 11.

FIG. 11 illustrates a cross-sectional end view of yet another lighting system 500 that constitutes at least a portion of a suspended ceiling grid system, according to one embodiment of the present disclosure, and FIG. 12 illustrates a perspective view of an exemplary lighting unit 100 employed in the system of FIG. 11. In the system of FIG. 11, there is no specific provision for a segregated air flow conduit and/or an air circulation device in the central channel portion 520 of the lighting interface component; rather, a somewhat more simplified design of the lighting interface component depends more heavily on the construction of the lighting unit itself to facilitate thermal transfer from the lighting unit, without requiring an air circulation device in either the lighting unit or the lighting interface component.

In particular, as shown in FIG. 11, the central channel portion 520 of the lighting interface component 510 is depicted as having a trapezoidally-shaped structural support member 518. Unlike the embodiments discussed above in connection with FIGS. 6-10, the central channel portion 520 does not include any cross member 534; rather, conductive tracks 524 are integrated directly on the structural support member 518 (and appropriate insulation is provided, if necessary, depending on the material used for the structural support member). A pair of resilient or essentially rigid members 570 are integrated with (or form part of) the structural support member 518, and provide for a snap-fit mechanical connection with the lighting unit 100 via essentially rigid tabs 572 formed on a housing 574 of the lighting unit. Electrical contacts 542 also are provided on the lighting unit housing 574 to make the electrical connection with the conductive tracks 524 when the lighting unit is coupled to (e.g., snapped into) the lighting interface component 510.

In the embodiment of FIGS. 11 and 12, the lighting unit housing 574 also may be configured with multiple fins and/or surface deformations 576 to facilitate thermal transfer from the lighting unit to the space inside the central channel portion 520. In one aspect, the housing 574 may be formed of die cast aluminum of other low thermal resistance material to facilitate heat dissipation. In another aspect, the housing 574 may be configured such that the generation of light from the lighting unit is not projected directly down from the plane of the suspended ceiling, but rather at an angle (e.g., so as to project light along a nearby wall). An optical facility 130 serving as a light exit face cover for the lighting unit also may be configured to assist in the projection of light in a direction that is off-normal with respect to the plane of the suspended ceiling.

Figure 13:
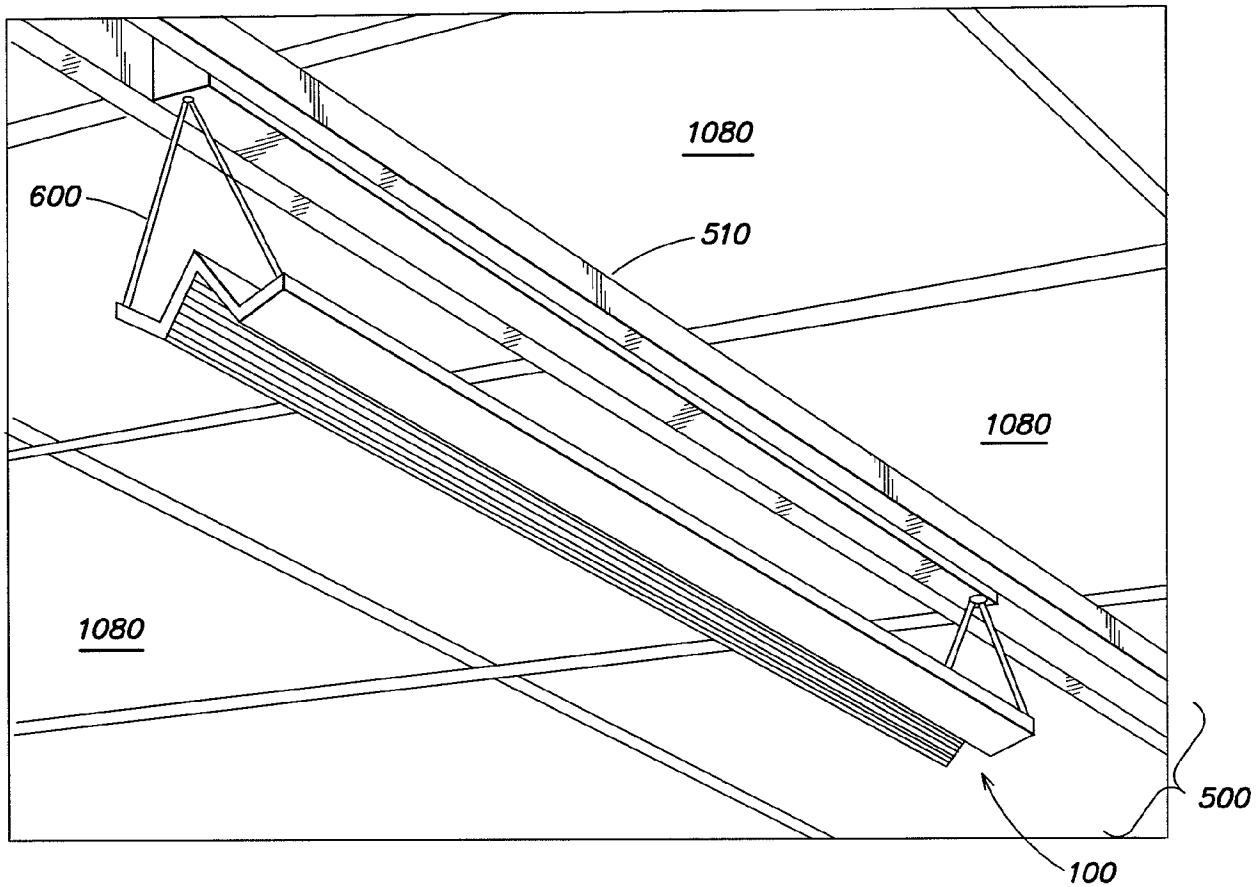
FIGS. 13 and 14 illustrate perspective and cross-sectional end views, respectively, of a lighting system that constitutes at least a portion of a suspended ceiling grid system, according to another embodiment of the present disclosure.
Figure 14:
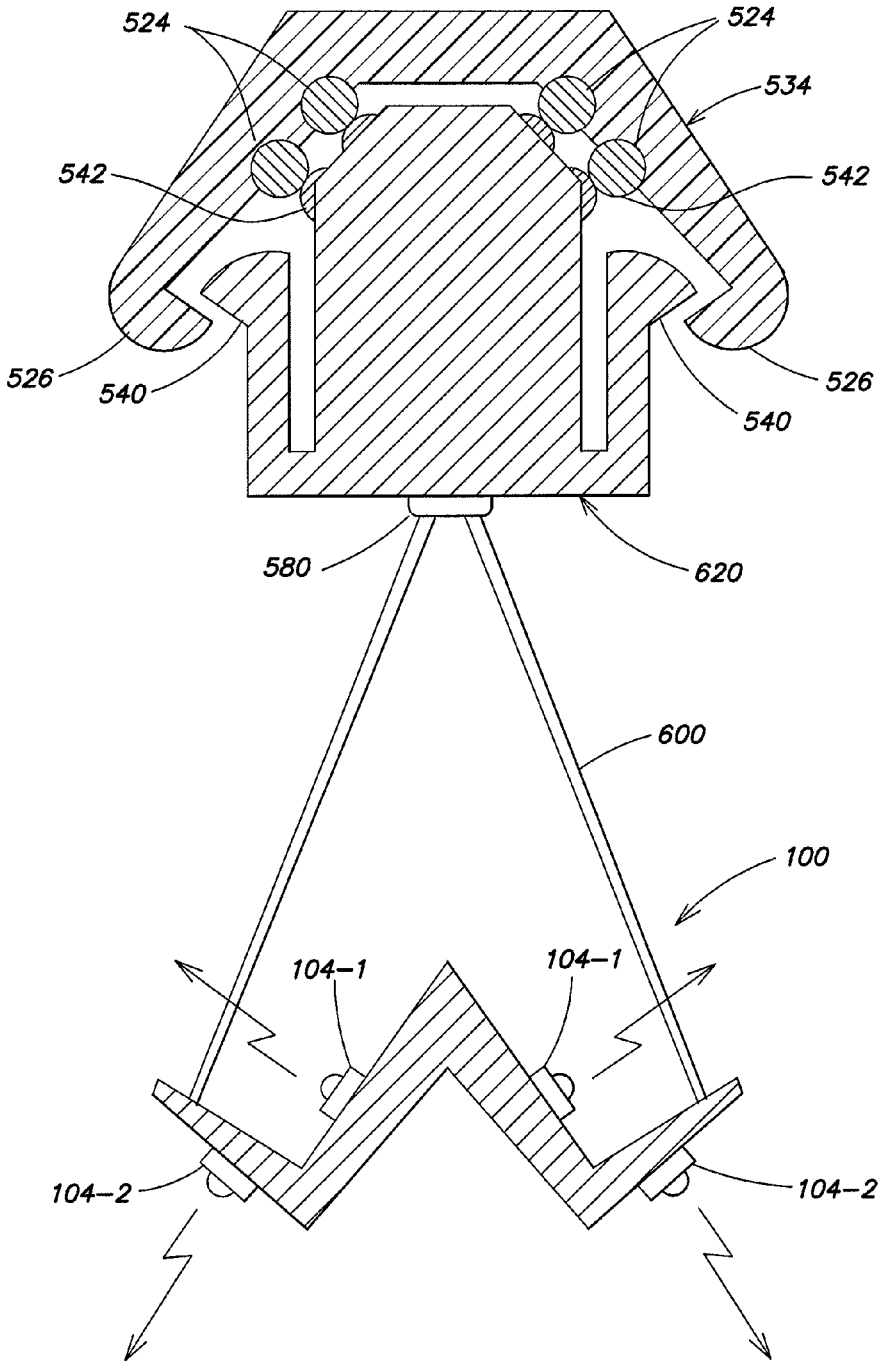

FIGS. 13 and 14 illustrate perspective and cross-sectional end views, respectively, of a lighting system 500 that constitutes at least a portion of a suspended ceiling grid system, according to yet another embodiment of the present disclosure. In the embodiment of FIGS. 13 and 14, the lighting unit 100 is suspended (e.g., via wires or cables 600) from a lighting interface component 510 such that the lighting unit hangs below a lower surface of the suspended ceiling. The wires or cables 600 may include electrical conductors for providing at least operating power and optionally one or more control signals to the pendant lighting unit.

As shown in FIG. 14, the wires or cables 600 are coupled via a coupling mechanism 580 (e.g., one or more interlocking connectors, or passing through a grommet) to a head 620 that is similar in overall construction to the air circulation component housing 546 shown in the embodiment of FIGS. 8 and 9. In particular, the head 620 is configured for snap-fit mechanical engagement, via the resilient tabs 540, to the rails 526 of the cross member 534. As discussed above, the electrical connection may be provided by the conductive tracks 524 and electrical contacts 542 disposed on the head, which contacts in turn are coupled to one or more of the wires or cables 600 (of course, other types of electrical connections are possible, as discussed above in connection with FIGS. 6 and 7).

A variety of configurations are possible for the pendant lighting unit 100 shown in FIGS. 13 and 14, including configurations that provide for one or both of up-lighting (light generation directed upwards toward the lower surface of the suspended ceiling, as shown in FIG. 14, so as to provide diffuse, even, non-glare illumination) or down-lighting (light generation directed into a room or space below the lower surface of the suspended ceiling. In particular, FIG. 14 depicts a lighting unit equipped with one or more upwardly directed light sources 104-1 and one or more downwardly directed light sources 104-2 (it should be appreciated that, in other embodiments, pendant lighting units may have only upwardly directed light sources or only downwardly directed light sources). In one exemplary implementation, the upwardly directed light sources 104-1 may be controlled independently of the downwardly directed light sources 104-2 to separately provide indirect or direct lighting, or simultaneously provide both forms of lighting. A variety of control methods including, but not limited to, manual, automatic (e.g., programmed), networked, and sensor-responsive control methods, are discussed in detail below in connection with FIGS. 15 and 16. For example, in a sensor-responsive implementation, significant natural ambient light levels in a room (e.g., daylight streaming in via one or more windows) may reduce the need for some portion of the lighting, and lighting brightness levels may be adjusted automatically based on daylight sensing (e.g., for lighting units configured to provide both direct and indirect lighting, the indirect lighting may be significantly reduced or completely turned off in response to high ambient daylight conditions, resulting in energy savings).

While a lighting unit configured to provide indirect and/or direct lighting in connection with the grid system of a suspended ceiling is presented above in the context of the pendant lighting unit shown in FIGS. 13 and 14, it should be appreciated that the concept of lighting units having independently controllable indirect and direct lighting capabilities may be implemented in other embodiments. For example, with reference again to FIG. 9, the lighting unit 100 shown in FIG. 9 may be alternatively configured to include one or more side-emitting light sources positioned along the area defined by (and in place of) the external surface features 530 which generate light directed to the left and right sides, in addition to (or in place of), one or more downwardly directed light sources 104. Such a lighting unit, and the lighting interface component to which it is coupled, may be designed such that when the lighting unit is installed in the lighting interface component, the side-emitting sources are appropriately positioned to generate light that grazes the lower surface of the suspended ceiling.

Figure 15:
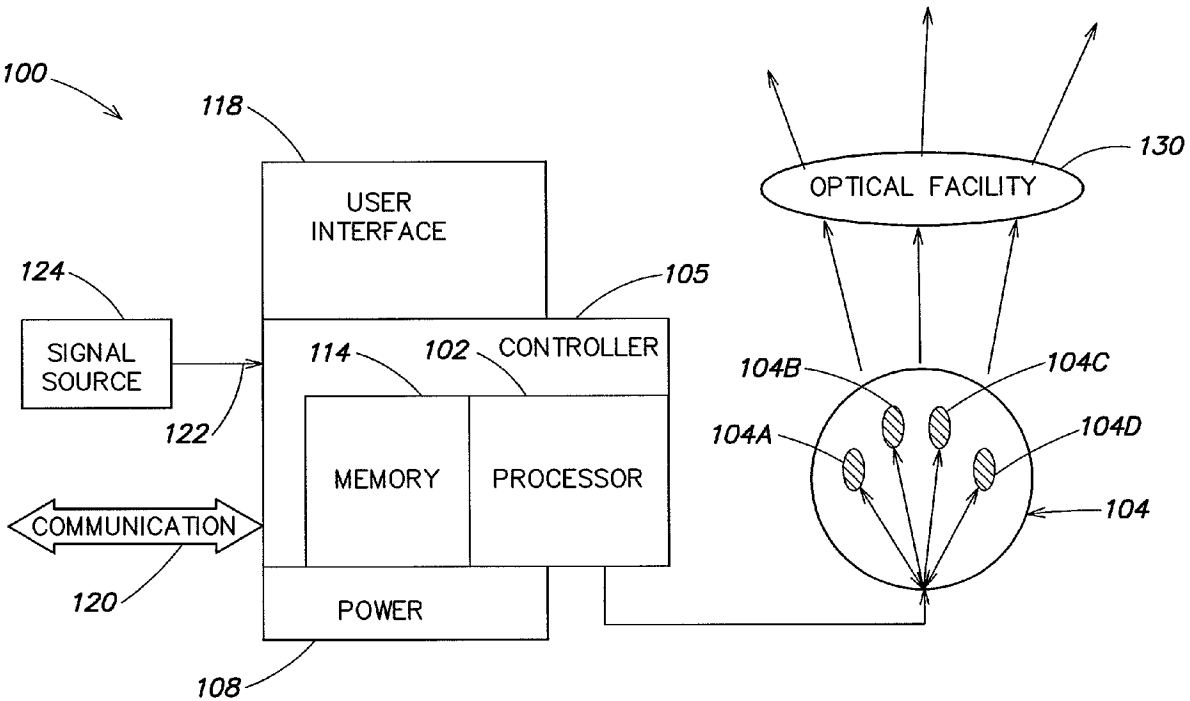
FIG. 15 illustrates various components of an LED-based lighting unit, according to one embodiment of the present disclosure.

In any of the various embodiments discussed above, and in other embodiments pursuant to the concepts discussed herein, one or more lighting units employed to provide lighting via a grid system of a suspended ceiling may be an LED-based lighting unit. FIG. 15 illustrates one example of such an LED-based lighting unit 100 according to one embodiment of the present disclosure. Some general examples of LED-based lighting units similar to those that are described below in connection with FIG. 15 may be found, for example, in U.S. Pat. No. 6,016,038, issued Jan. 18, 2000 to Mueller et al., entitled "Multicolored LED Lighting Method and Apparatus," and U.S. Pat. No. 6,211,626, issued Apr. 3, 2001 to Lys et al, entitled "Illumination Components," which patents are both hereby incorporated herein by reference.

In various embodiments of the present disclosure, the lighting unit 100 shown in FIG. 15 may be used alone or together with other similar lighting units in a system of lighting units (e.g., as discussed further below in connection with FIG. 16). Used alone or in combination with other lighting units, the lighting unit 100 may be employed in a variety of applications including, but not limited to, interior or exterior space (e.g., architectural) lighting and illumination in general, direct or indirect illumination of objects or spaces, decorative lighting, safety-oriented lighting, lighting associated with (or illumination of) displays and/or merchandise (e.g. for advertising and/or in retail/consumer environments), combined lighting or illumination and communication systems, and various indication and informational purposes. Additionally, one or more lighting units similar to that described in connection with FIG. 15 may be implemented in a variety of products including, but not limited to, various forms of light modules or bulbs having various shapes and electrical/mechanical coupling arrangements suitable for coupling to various lighting interface components associated with suspended ceilings, as discussed above.

In one embodiment, the lighting unit 100 shown in FIG. 15 may include one or more light sources 104A, 104B, 104C, and 104D (shown collectively as 104), wherein one or more of the light sources may be an LED-based light source that includes one or more light emitting diodes (LEDs). In one aspect of this embodiment, any two or more of the light sources may be adapted to generate radiation of different colors (e.g. red, green, blue); in this respect, each of the different color light sources generates a different source spectrum that constitutes a different "channel" of a "multi-channel" lighting unit. Although FIG. 15 shows four light sources 104A, 104B, 104C, and 104D, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

As shown in FIG. 15, the lighting unit 100 also may include a controller 105 that is configured to output one or more control signals to drive the light sources so as to generate various intensities of light from the light sources. For example, in one implementation, the controller 105 may be configured to output at least one control signal for each light source so as to independently control the intensity of light (e.g., radiant power in lumens) generated by each light source; alternatively, the controller 105 may be configured to output one or more control signals to collectively control a group of two or more light sources identically. Some examples of control signals that may be generated by the controller to control the light sources include, but are not limited to, pulse modulated signals, pulse width modulated signals (PWM), pulse amplitude modulated signals (PAM), pulse code modulated signals (PCM) analog control signals (e.g., current control signals, voltage control signals), combinations and/or modulations of the foregoing signals, or other control signals. In one aspect, particularly in connection with LED-based sources, one or more modulation techniques provide for variable control using a fixed current level applied to one or more LEDs, so as to mitigate potential undesirable or unpredictable variations in LED output that may arise if a variable LED drive current were employed. In another aspect, the controller 105 may control other dedicated circuitry (not shown in FIG. 15) which in turn controls the light sources so as to vary their respective intensities.

In general, the intensity (radiant output power) of radiation generated by the one or more light sources is proportional to the average power delivered to the light source(s) over a given time period. Accordingly, one technique for varying the intensity of radiation generated by the one or more light sources involves modulating the power delivered to (i.e., the operating power of) the light source(s). For some types of light sources, including LED-based sources, this may be accomplished effectively using a pulse width modulation (PWM) technique.

In one exemplary implementation of a PWM control technique, for each channel of a lighting unit a fixed predetermined voltage $V_{source}$ is applied periodically across a given light source constituting the channel. The application of the voltage $V_{source}$ may be accomplished via one or more switches, not shown in FIG. 15, controlled by the controller 105. While the voltage $V_{source}$ is applied across the light source, a predetermined fixed current $I_{source}$ (e.g., determined by a current regulator, also not shown in FIG. 15) is allowed to flow through the light source. Again, recall that an LED-based light source may include one or more LEDs, such that the voltage $V_{source}$ may be applied to a group of LEDs constituting the source, and the current $I_{source}$ may be drawn by the group of LEDs. The fixed voltage $V_{source}$ across the light source when energized, and the regulated current $I_{source}$ drawn by the light source when energized, determines the amount of instantaneous operating power $P_{source}$ of the light source ($P_{source}=V_{source}\cdot I_{source}$). As mentioned above, for LED-based light sources, using a regulated current mitigates potential undesirable or unpredictable variations in LED output that may arise if a variable LED drive current were employed.

According to the PWM technique, by periodically applying the voltage $V_{source}$ to the light source and varying the time the voltage is applied during a given on-off cycle, the average power delivered to the light source over time (the average operating power) may be modulated. In particular, the controller 105 may be configured to apply the voltage $V_{source}$ to a given light source in a pulsed fashion (e.g., by outputting a control signal that operates one or more switches to apply the voltage to the light source), preferably at a frequency that is greater than that capable of being detected by the human eye (e.g., greater than approximately 100 Hz). In this manner, an observer of the light generated by the light source does not perceive the discrete on-off cycles (commonly referred to as a "flicker effect"), but instead the integrating function of the eye perceives essentially continuous light generation. By adjusting the pulse width (i.e. on-time, or "duty cycle") of on-off cycles of the control signal, the controller varies the average amount of time the light source is energized in any given time period, and hence varies the average operating power of the light source. In this manner, the perceived brightness of the generated light from each channel in turn may be varied.

As discussed in greater detail below, the controller 105 may be configured to control each different light source channel of a multi-channel lighting unit at a predetermined average operating power to provide a corresponding radiant output power for the light generated by each channel. Alternatively, the controller 105 may receive instructions (e.g., "lighting commands" or "lighting control signals") from a variety of origins, such as a user interface 118, a signal source 124, or one or more communication ports 120, that specify prescribed operating powers for one or more channels and, hence, corresponding radiant output powers for the light generated by the respective channels. By varying the prescribed operating powers for one or more channels (e.g., pursuant to different instructions, control signals, or lighting commands), different perceived colors and brightness levels of light may be generated by the lighting unit.

In one embodiment of the lighting unit 100, as mentioned above, one or more of the light sources 104A, 104B, 104C, and 104D shown in FIG. 15 may include a group of multiple LEDs or other types of light sources (e.g., various parallel and/or serial connections of LEDs or other types of light sources) that are controlled together by the controller 105. Additionally, it should be appreciated that one or more of the light sources may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit 100.

In another aspect of the lighting unit 100 shown in FIG. 15, the lighting unit 100 may be constructed and arranged to produce a wide range of variable color radiation. For example, in one embodiment, the lighting unit 100 may be particularly arranged such that controllable variable intensity (i.e., variable radiant power) light generated by two or more of the light sources combines to produce a mixed colored light (including essentially white light having a variety of color temperatures). In particular, the color (or color temperature) of the mixed colored light may be varied by varying one or more of the respective intensities (output radiant power) of the light sources (e.g., in response to one or more control signals output by the controller 105). Furthermore, the controller 105 may be particularly configured to provide control signals to one or more of the light sources so as to generate a variety of static or time-varying (dynamic) multi-color (or multi-color temperature) lighting effects. To this end, in one embodiment, the controller may include a processor 102 (e.g., a microprocessor) programmed to provide such control signals to one or more of the light sources. In various aspects, the processor 102 may be programmed to provide such control signals autonomously, in response to lighting commands, or in response to various user or signal inputs.

Thus, the lighting unit 100 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. Such combinations of differently colored LEDs in the lighting unit 100 can facilitate accurate reproduction of a host of desirable spectrums of lighting conditions, examples of which include, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments.

As shown in FIG. 15, the lighting unit 100 also may include a memory 114 to store various information. For example, the memory 114 may be employed to store one or more lighting commands or programs for execution by the processor 102 (e.g., to generate one or more control signals for the light sources), as well as various types of data useful for generating variable color radiation (e.g., calibration information, discussed further below). The memory 114 also may store one or more particular identifiers (e.g., a serial number, an address, etc.) that may be used either locally or on a system level to identify the lighting unit 100. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

In another aspect, as also shown in FIG. 15, the lighting unit 100 optionally may include one or more user interfaces 118 that are provided to facilitate any of a number of user-selectable settings or functions (e.g., generally controlling the light output of the lighting unit 100, changing and/or selecting various pre-programmed lighting effects to be generated by the lighting unit, changing and/or selecting various parameters of selected lighting effects, setting particular identifiers such as addresses or serial numbers for the lighting unit, etc.). In various embodiments, the communication between the user interface 118 and the lighting unit may be accomplished through wire or cable, or wireless transmission.

In one implementation, the controller 105 of the lighting unit monitors the user interface 118 and controls one or more of the light sources 104A, 104B, 104C and 104D based at least in part on a user's operation of the interface. For example, the controller 105 may be configured to respond to operation of the user interface by originating one or more control signals for controlling one or more of the light sources. Alternatively, the processor 102 may be configured to respond by selecting one or more pre-programmed control signals stored in memory, modifying control signals generated by executing a lighting program, selecting and executing a new lighting program from memory, or otherwise affecting the radiation generated by one or more of the light sources.

In particular, in one implementation, the user interface 118 may constitute one or more switches (e.g., a standard wall switch) that interrupt power to the controller 105. As discussed above in connection with FIGS. 4-14, operating power to the lighting unit, and hence the controller 105, may be provided via an electrical connection facilitated by the lighting interface component 510 of a lighting system 500. In one aspect of this implementation, the operating power provided by such an electrical connection is interrupted by one or more switches such as a standard wall switch. The controller 105 is configured to monitor the power as controlled by the user interface, and in turn control one or more of the light sources based at least in part on a duration of a power interruption caused by operation of the user interface. As discussed above, the controller may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

FIG. 15 also illustrates that the lighting unit 100 may be configured to receive one or more signals 122 from one or more other signal sources 124. In one implementation, the controller 105 of the lighting unit may use the signal(s) 122, either alone or in combination with other control signals (e.g., signals generated by executing a lighting program, one or more outputs from a user interface, etc.), so as to control one or more of the light sources 104A, 104B, 104C and 104D in a manner similar to that discussed above in connection with the user interface.

Examples of the signal(s) 122 that may be received and processed by the controller 105 include, but are not limited to, one or more audio signals, video signals, power signals, various types of data signals, signals representing information obtained from a network (e.g., the Internet), signals representing one or more detectable/sensed conditions, signals from lighting units, signals including modulated light, etc. In various implementations, the signal source(s) 124 may be located remotely from the lighting unit 100, or included as a component of the lighting unit. In one embodiment, a signal from one lighting unit 100 could be sent over a network to another lighting unit 100.

Some examples of a signal source 124 that may be employed in, or used in connection with, the lighting unit 100 of FIG. 15 include any of a variety of sensors or transducers that generate one or more signals 122 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., photodiodes, sensors that are sensitive to one or more particular spectra of electromagnetic radiation such as spectroradiometers or spectrophotometers, etc.), various types of cameras, sound or vibration sensors or other pressure/force transducers (e.g., microphones, piezoelectric devices), and the like.

Additional examples of a signal source 124 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 122 based on measured values of the signals or characteristics. Yet other examples of a signal source 124 include various types of scanners, image recognition systems, voice or other sound recognition systems, artificial intelligence and robotics systems, and the like. A signal source 124 could also be a lighting unit 100, another controller or processor, or any one of many available signal generating devices, such as media players, MP3 players, computers, DVD players, CD players, television signal sources, camera signal sources, microphones, speakers, telephones, cellular phones, instant messenger devices, SMS devices, wireless devices, personal organizer devices, and many others.

In one embodiment, the lighting unit 100 shown in FIG. 15 also may include one or more optical elements 130 to optically process the radiation generated by the light sources 104A, 104B, 104C, and 104D. For example, one or more optical elements may be configured so as to change one or both of a spatial distribution and a propagation direction of the generated radiation. In particular, one or more optical elements may be configured to change a diffusion angle of the generated radiation. In one aspect of this embodiment, one or more optical elements 130 may be particularly configured to variably change one or both of a spatial distribution and a propagation direction of the generated radiation (e.g., in response to some electrical and/or mechanical stimulus). Examples of optical elements that may be included in the lighting unit 100 include, but are not limited to, reflective materials, refractive materials, translucent materials, filters, lenses, mirrors, and fiber optics. The optical element 130 also may include a phosphorescent material, luminescent material, or other material capable of responding to or interacting with the generated radiation.

As also shown in FIG. 15, the lighting unit 100 may include one or more communication ports 120 to facilitate coupling of the lighting unit 100 to any of a variety of other devices. For example, one or more communication ports 120 may facilitate coupling multiple lighting units together as a networked lighting system, in which at least some of the lighting units are addressable (e.g., have particular identifiers or addresses) and are responsive to particular data transported across the network. One or more communication ports 120 of a lighting unit may include electrical contacts similar to the contacts 542 shown in various figures and discussed above in connection with FIGS. 4-14. Such contacts facilitate an electrical connection with a lighting interface component 510 (e.g., via one or more conductive tracks 524), thereby providing an electrical path for a source of control signals (e.g., lighting commands or instructions, data, etc.) for the lighting unit.

In a networked lighting system environment, as discussed in greater detail further below (e.g., in connection with FIG. 16), as data is communicated via the network, the controller 105 of each lighting unit coupled to the network may be configured to be responsive to particular data (e.g., lighting control commands) that pertain to it (e.g., in some cases, as dictated by the respective identifiers of the networked lighting units). Once a given controller identifies particular data intended for it, it may read the data and, for example, change the lighting conditions produced by its light sources according to the received data (e.g., by generating appropriate control signals to the light sources). In one aspect, the memory 114 of each lighting unit coupled to the network may be loaded, for example, with a table of lighting control signals that correspond with data the processor 102 of the controller receives. Once the processor 102 receives data from the network, the processor may consult the table to select the control signals that correspond to the received data, and control the light sources of the lighting unit accordingly.

In one aspect of this embodiment, the processor 102 of a given lighting unit, whether or not coupled to a network, may be configured to interpret lighting instructions/data that are received in a DMX protocol (as discussed, for example, in U.S. Pat. Nos. 6,016,038 and 6,211,626), which is a lighting command protocol conventionally employed in the lighting industry for some programmable lighting applications. For example, in one aspect, considering for the moment a lighting unit based on red, green and blue LEDs (i.e., an "R-G-B" lighting unit), a lighting command in DMX protocol may specify each of a red channel command, a green channel command, and a blue channel command as eight-bit data (i.e., a data byte) representing a value from 0 to 255. The maximum value of 255 for any one of the color channels instructs the processor 102 to control the corresponding light source(s) to operate at maximum available power (i.e., 100%) for the channel, thereby generating the maximum available radiant power for that color (such a command structure for an R-G-B lighting unit commonly is referred to as 24-bit color control). Hence, a command of the format [R, G, B]=[255, 255, 255] would cause the lighting unit to generate maximum radiant power for each of red, green and blue light (thereby creating white light).

It should be appreciated, however, that lighting units suitable for purposes of the present disclosure are not limited to a DMX command format, as lighting units according to various embodiments may be configured to be responsive to other types of communication protocols/lighting command formats so as to control their respective light sources. In general, the processor 102 may be configured to respond to lighting commands in a variety of formats that express prescribed operating powers for each different channel of a multi-channel lighting unit according to some scale representing zero to maximum available operating power for each channel.

In one embodiment, the lighting unit 100 of FIG. 15 may include and/or be coupled to one or more power sources 108. As discussed above, the lighting unit 100 typically would be coupled to the power source 108 via an electrical connection provided by a lighting interface component 510 (e.g., conductive tracks 524) so as to provide operating power to the lighting unit.

While not shown explicitly in FIG. 15, the lighting unit 100 may be implemented in any one of several different structural configurations according to various embodiments of the present disclosure. Examples of such configurations include, but are not limited to, an essentially linear or curvilinear configuration, a circular configuration, an oval configuration, a rectangular configuration, combinations of the foregoing, various other geometrically shaped configurations, various two or three dimensional configurations, and the like. A given lighting unit also may have any one of a variety of mounting arrangements for the light source(s) and enclosure/housing arrangements and shapes to partially or fully enclose the light sources.

Additionally, one or more optical elements as discussed above may be partially or fully integrated with an enclosure/housing arrangement for the lighting unit. Furthermore, the various components of the lighting unit discussed above (e.g., processor, memory, user interface, etc.), as well as other components that may be associated with the lighting unit in different implementations (e.g., sensors/transducers, other components to facilitate communication to and from the unit, etc.) may be packaged in a variety of ways; for example, in one aspect, any subset or all of the various lighting unit components, as well as other components that may be associated with the lighting unit, may be packaged together. In another aspect, packaged subsets of components may be coupled together electrically and/or mechanically in a variety of manners.

Figure 16:
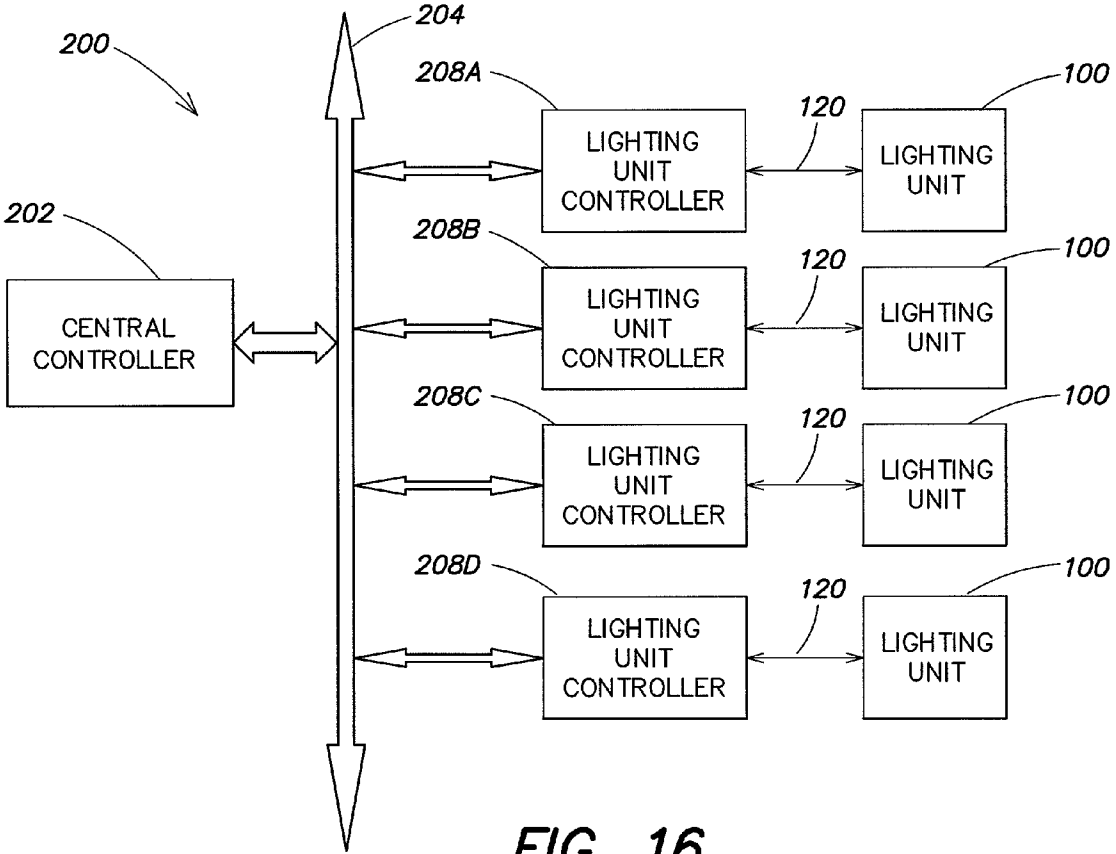
FIG. 16 illustrates a network configuration of multiple LED-based lighting units similar to those shown in FIG. 15, according to one embodiment of the present disclosure.

FIG. 16 illustrates an example of a networked lighting system 200 according to one embodiment of the present disclosure. In the embodiment of FIG. 16, a number of lighting units 100, similar to those discussed above in connection with FIG. 15, are coupled together to form the networked lighting system. It should be appreciated, however, that the particular configuration and arrangement of lighting units shown in FIG. 16 is for purposes of illustration only, and that the disclosure is not limited to the particular system topology shown in FIG. 16. In one exemplary implementation, multiple lighting units are coupled to one or more lighting interface components 510 of a lighting system 500 that forms at least a portion of a grid system for a suspended ceiling.

While not shown explicitly in FIG. 16, it should be appreciated that the networked lighting system 200 may be configured flexibly to include one or more user interfaces, as well as one or more signal sources such as sensors/transducers. For example, one or more user interfaces and/or one or more signal sources such as sensors/transducers (as discussed above in connection with FIG. 15) may be associated with any one or more of the lighting units of the networked lighting system 200. Alternatively (or in addition to the foregoing), one or more user interfaces and/or one or more signal sources may be implemented as "stand alone" components in the networked lighting system 200. Whether stand alone components or particularly associated with one or more lighting units 100, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

As shown in the embodiment of FIG. 16, the lighting system 200 may include one or more lighting unit controllers (hereinafter "LUCs") 208A, 208B, 208C, and 208D, wherein each LUC is responsible for communicating with and generally controlling one or more lighting units 100 coupled to it. Although FIG. 16 illustrates one lighting unit 100 coupled to each LUC, it should be appreciated that the disclosure is not limited in this respect, as different numbers of lighting units 100 may be coupled to a given LUC in a variety of different configurations (serially connections, parallel connections, combinations of serial and parallel connections, etc.) using a variety of different communication media and protocols. In one implementation, an LUC provides control information to one or more lighting units via the electrical connection provided by a lighting interface component 510 of a lighting system 500 as described above. In one aspect of such an implementation, one or more LUCs may be disposed in the plenum 1140 above the suspended ceiling, and may be physically attached to the recessed portion of a lighting interface component or other architectural feature above the suspended ceiling.

In the system of FIG. 16, each LUC in turn may be coupled to a central controller 202 that is configured to communicate with one or more LUCs. Although FIG. 16 shows four LUCs coupled to the central controller 202 via a generic connection 204 (which may include any number of a variety of conventional coupling, switching and/or networking devices), it should be appreciated that according to various embodiments, different numbers of LUCs may be coupled to the central controller 202. Additionally, according to various embodiments of the present disclosure, the LUCs and the central controller may be coupled together in a variety of configurations using a variety of different communication media and protocols to form the networked lighting system 200. Moreover, it should be appreciated that the interconnection of LUCs and the central controller, and the interconnection of lighting units to respective LUCs, may be accomplished in different manners (e.g., using different configurations, communication media, and protocols).

For example, according to one embodiment of the present disclosure, the central controller 202 shown in FIG. 16 may by configured to implement Ethernet-based communications with the LUCs, and in turn the LUCs may be configured to implement DMX-based communications with the lighting units 100. In particular, in one aspect of this embodiment, each LUC may be configured as an addressable Ethernet-based controller and accordingly may be identifiable to the central controller 202 via a particular unique address (or a unique group of addresses) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more lighting units coupled to it, for example, via a DMX protocol, based on the Ethernet communications with the central controller 202.

More specifically, according to one embodiment, the LUCs 208A, 208B, and 208C shown in FIG. 16 may be configured to be "intelligent" in that the central controller 202 may be configured to communicate higher level commands to the LUCs that need to be interpreted by the LUCs before lighting control information can be forwarded to the lighting units 100. For example, a lighting system operator may want to generate a color changing effect that varies colors from lighting unit to lighting unit in such a way as to generate the appearance of a propagating rainbow of colors ("rainbow chase"), given a particular placement of lighting units with respect to one another. In this example, the operator may provide a simple instruction to the central controller 202 to accomplish this, and in turn the central controller may communicate to one or more LUCs using an Ethernet-based protocol high level command to generate a "rainbow chase." The command may contain timing, intensity, hue, saturation or other relevant information, for example. When a given LUC receives such a command, it may then interpret the command and communicate further commands to one or more lighting units using a DMX protocol, in response to which the respective sources of the lighting units are controlled via any of a variety of signaling techniques (e.g., PWM).

It should again be appreciated that the foregoing example of using multiple different communication implementations (e.g., Ethernet/DMX) in a lighting system according to one embodiment of the present disclosure is for purposes of illustration only, and that the disclosure is not limited to this particular example.

From the foregoing, it may be appreciated that one or more lighting units as discussed above are capable of generating highly controllable variable color light over a wide range of colors, as well as variable color temperature white light over a wide range of color temperatures.

Having thus described several illustrative embodiments, it is to be appreciated that various alterations, modifications, and improvements will readily occur to those skilled in the art. Such alterations, modifications, and improvements are intended to be part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Accordingly, the foregoing description and attached drawings are by way of example only, and are not intended to be limiting.

The invention claimed is:

1. A lighting interface component that forms at least a portion of a grid system for a suspended ceiling, comprising:

a central channel portion having first and second structural support members;

said first structural support member having a first flange, said first flange configured to support a first ceiling tile;

said second structural support member having a second flange, said second flange configured to support a second ceiling tile;

a cross member positioned between said first and said second structural support member and having a plurality of conductive tracks positioned on a first surface;

said cross member receiving at least one lighting unit on said first surface, said lighting unit positionable along said cross member;

a plurality of cooling features extending from a second surface of said cross member and into an enclosed air handling plenum;

wherein said enclosed air handling plenum forms an air flow channel within said central channel portion;

said lighting unit in thermal connectivity with said plurality of cooling features of said cross member;

wherein heat generated by a plurality of light sources positioned on said lighting unit is dissipated by at least some of said plurality of cooling features of said cross member.

2. The lighting interface component of claim 1 further including at least one perforation included in said cross member to allow air exchange to an area below said first and said second flanges.

3. The lighting interface component of claim 1 wherein said lighting unit is a printed circuit board with a plurality of LEDs, said plurality of LEDs in thermal connectivity with said plurality of cooling features in said enclosed hair handling plenum.

4. The lighting interface component of claim 1 wherein said air flow channel is positioned above said cross member support and said lighting unit.

5. The lighting interface component of claim 1 wherein said first and said second structural support members are integral with respective said first and second flange.

6. The lighting interface component of claim 1 wherein said lighting unit is retained within said central channel portion.

7. The lighting interface component of claim 1 wherein said cross member support includes cross member support rails configured to engage said at least one lighting unit.

8. The lighting interface component of claim 1 further including at least one air circulation component to facilitate a flow of air within said air flow channel.

9. The lighting interface component of claim 8 wherein said air circulation component is a fan positioned at a first end of said central channel portion increasing air flow over said heat dissipating cooling members thereby dissipating heat generated by said at least one lighting unit.

10. A lighting interface component that forms at least a portion of a grid system for a suspended ceiling, comprising:

first and second structural support members extending downwards to respective first and second flange members;

said first and second structural support members forming an open internal area for receiving a cross member support, said cross member support firmly retained between said first and said second structural support member;

said cross member support further having a plurality of electrical contacts extending longitudinally thereon;

wherein said first and said second flanges are configured to support portions of respective first and second ceiling tiles;

a lighting unit having a linear base member received between said first and said second structural support member;

said lighting unit further having a first housing extending upwards from a first end of said linear base unit, said first housing having a plurality of contacts;

wherein said linear base member has an upper surface with a plurality of cooling surface features;

said lighting unit retained by said cross member support;

said cross member support forming an air channel such that said plurality of cooling surface features extend into said air channel and facilitate the cooling of said lighting unit by dissipation of heat into said channel.

11. The lighting interface component of claim 10 wherein said first housing has a fan circulation unit formed therein to aid in circulation within said air channel.

12. The lighting interface component of claim 10 wherein said cross member support retains said housing at a first and second tab of said first housing formed on said lighting unit and forming said air channel when retained by said first and second tabs.

13. The lighting interface component of claim 10 wherein said cross member support further has longitudinally extending rails, said longitudinally extending rails engaging first and second tab formations on said first housing of said lighting unit.

14. The lighting interface component of claim 13 wherein said lighting unit has a second upwardly extending housing opposite said first housing, said first and said second housing enclosing a space defined by a lower surface of said cross member support and said first and said second housings.

15. The lighting interface component of claim 14 wherein said first housing includes a fan for circulation of air into said air channel.

16. A lighting interface component that forms at least a portion of a grid system for a suspended ceiling, comprising:

a housing having a first and a second structural support member, each of said first and said second structural support member ending in an outwardly extending flange;

a cross member support having a plurality of longitudinally extending conductive tracks on a first surface;

a hollow air flow conduit formed above said cross member support and between said first and said second structural support;

wherein said cross member support has a plurality of thermal conductive features on a second surface extending into said hollow air flow conduit;

a plurality of lighting units retained on said cross member support, each of said lighting units having at least one LED affixed to a substrate, said substrate having a plurality of electrical contacts which engage said plurality of longitudinally extending conductive tracks on said first surface of said cross member support;

wherein said substrate is in thermal transfer engagement with said plurality of thermal conductive features on said second surface of said cross member support thereby dissipating heat energy from said at least one LEDs into said hollow air flow conduit.

* * * * *